US009759016B2

(12) United States Patent
Perez et al.

(10) Patent No.: US 9,759,016 B2
(45) Date of Patent: Sep. 12, 2017

(54) PROTECTION ASSEMBLY FOR DOWNHOLE WET CONNECTORS

(71) Applicant: HALLIBURTON ENERGY SERVICES, INC., Houston, TX (US)

(72) Inventors: Eddie Perez, Carrollton, TX (US); Bryon Mullen, Carrollton, TX (US); William Germany, Denton, TX (US); William Richards, Frisco, TX (US); William Henderson, Tioga, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 14/122,369

(22) PCT Filed: Jan. 10, 2013

(86) PCT No.: PCT/US2013/021080
§ 371 (c)(1),
(2) Date: Nov. 26, 2013

(87) PCT Pub. No.: WO2014/109753
PCT Pub. Date: Jul. 17, 2014

(65) Prior Publication Data

US 2016/0356095 A1 Dec. 8, 2016

(51) Int. Cl.

| | |
|---|---|
| ***E21B 17/02*** | (2006.01) |
| ***E21B 47/12*** | (2012.01) |
| ***E21B 17/00*** | (2006.01) |

(52) U.S. Cl.
CPC ..... *E21B 17/021* (2013.01); *E21B 17/003* (2013.01); *E21B 17/023* (2013.01); *E21B 17/028* (2013.01); *E21B 47/123* (2013.01)

(58) Field of Classification Search
CPC .... E21B 17/021; E21B 47/123; E21B 17/003; E21B 17/028; E21B 17/023
See application file for complete search history.

(56) References Cited

U.S. PATENT DOCUMENTS 4,682,848 A 7/1987 Cairns et al.
4,696,540 A 9/1987 Adams et al.
(Continued)

OTHER PUBLICATIONS

Supplementary European Search Report for EP Application No. 13871242 dated Oct. 7, 2016, 9 pages.
(Continued)

*Primary Examiner* — Brad Harcourt
(74) *Attorney, Agent, or Firm* — Haynes and Boone, LLP

(57) ABSTRACT

The invention addresses protecting the free ends of communication lines from debris during downhole wet-mate connection in a wellbore, with protection of the lines upon disconnection as well. A reciprocating debris exclusion device is provided for use with upper and lower tools to be connected. The lower tool has a reciprocating cover member mounted for sliding engagement with the housing of the lower tool, the cover member shielding the free end of a communication line. An upper tool has a bladder-type cover member attached to the upper tool and protecting the free end of a communication line. The reciprocating cover member is moveable between a closed and an open position and is moved in response to contact with the upper tool. The bladder cover is movable between closed and open positions and is moved to the open position by contact with the reciprocating cover member of the lower tool.

20 Claims, 22 Drawing Sheets

(56) References Cited

U.S. PATENT DOCUMENTS

| | | | | |
|---|---|---|---|---|
| 6,776,636 | B1 * | 8/2004 | Cameron | E21B 17/028 439/191 |
| 6,902,414 | B2 | 6/2005 | Dopf et al. | |
| 7,510,003 | B2 | 3/2009 | Meijer et al. | |
| 7,798,212 | B2 | 9/2010 | Bolze et al. | |
| 8,122,967 | B2 | 2/2012 | Richards | |
| 2006/0243454 | A1 | 11/2006 | Bolze et al. | |
| 2008/0003894 | A1 | 1/2008 | Hall et al. | |
| 2008/0029274 | A1 | 2/2008 | Rytlewski et al. | |
| 2009/0045146 | A1 | 2/2009 | Stoesz | |
| 2009/0321069 | A1 | 12/2009 | Jonas | |
| 2012/0045917 | A1 | 2/2012 | Head | |
| 2012/0181045 | A1 | 7/2012 | Thomas et al. | |

OTHER PUBLICATIONS

Supplementary European Search Report for EP Application No. 13870444 dated Oct. 6, 2016, 7 pages.
International Search Report dated Oct. 8, 2013 for Application No. PCT/US2013/021080.
Written Opinion dated Oct. 8, 2013 for Application No. PCT/US2013/021080.
Examiner's Letter issued from the Canadian Intellectual Property Office regarding related Canadian application No. 2894487 dated Apr. 25, 2016, 4 pages.
International Search Report and Written Opinion dated Sep. 25, 2013 for Application No. PCT/US2013/021067.

* cited by examiner

PROTECTION ASSEMBLY FOR DOWNHOLE WET CONNECTORS

CROSS-REFERENCE TO RELATED APPLICATIONS

None.

FIELD OF INVENTION

Methods and apparatus are presented for connecting downhole connectors in a wellbore environment. More particularly, methods and apparatus are presented for protecting a Point of Interest prior to and during connection to another Point of Interest, for example, when making a downhole fiber optic connection.

BACKGROUND OF INVENTION

Without limiting the scope of the present invention, its background is described with reference to using optical fibers for communication in a subterranean wellbore environment, as an example. It is well known in the subterranean well completion and production arts that downhole sensors can be used to monitor a variety of parameters in the wellbore environment. For example, during a treatment operation, it may be desirable to monitor a variety of properties of the treatment fluid such as viscosity, temperature, pressure, velocity, specific gravity, conductivity, fluid composition and the like. Transmission of this information to the surface in real-time or near real-time allows the operators to modify or optimize such treatment operations to improve the completion process. One way to transmit this information to the surface is through the use of communication lines, such as one or more optical fibers, copper or metallic cables, or hydraulic or pressure lines. In addition, optical fibers may serve as sensors, where the optical fiber obtains distributed measurements related to a parameter along the length of the fiber.

In a typical wellbore treating or stimulation operation, a lower portion of completion string including various tools such as sand control screens, fluid flow control devices, wellbore isolation devices and the like is permanently installed in the wellbore. The lower portion of the completion string may include various sensors, particularly, a lower portion of optical fiber. After the stimulation process, an upper portion of the work string including an upper portion of optical fiber is separated from the lower completion string and retrieved to the surface. This operation cuts-off communication between the lower string, which remains in place, and the surface. Accordingly, if information from the production zones is to be transmitted to the surface during later production operations, a connection to the lower optical fiber must be reestablished when the production tubing string is installed.

It has been found, however, that wet-mating optical fibers in a downhole environment is very difficult. Difficulties due to lack of precision in the axial movement of the production string relative to the previously installed completion string are addressed, for example, in U.S. Pat. No. 8,122,967, to Richards, entitled *Apparatus and Method for Controlling the Connection and Disconnection Speed of Downhole Connectors*, which is hereby incorporated by reference for all purposes. Further disclosure regarding downhole connections can be found in U.S. Patent Application Publication 2012/0181045, to Thomas, entitled *Apparatus and Method for Controlling the Connection and Disconnection Speed of Downhole Connectors*, which is hereby incorporated by reference for all purposes.

Additionally, wet-mate connections or wet-connects have become prevalent, especially in off-shore deep wells where it is difficult to provide for a dry-connection. A downhole communication line and a connector are often left in place, such as at the upper end of a completion string or production string. A second tool string is later lowered into the wellbore, also having a communication line and connector. The communication connectors are mated to provide an operable communication link between the tools. While it is possible to lower tool strings with all of the communication lines and corresponding conduits in place, there is increasing interest in wet-connect or wet-mate capabilities, that is, connections made in a wet environment. Further, it is often necessary or desirable to disconnect the tools and repeat the process, as later tools are inserted into the well, to speed and simplify equipment changes, replacement, or employ different tool configurations over time.

Typically wet-connects are hydraulic or electric in nature, where a pressure-competent connection or an electrically isolated connection, respectively, must be created. These require a reasonably high degree of cleanliness and several methods are known to make these connections with varying success. With the increase in usage of fiber optic communication lines in particular, it has become critical to provide an especially "clean" connection between mating connectors. Fiber optic connections generally require relatively greater positional registration and cleanliness.

Therefore, a need has arisen for apparatus and methods for wet-connecting optical fibers and other communication lines in a subterranean wellbore environment.

SUMMARY OF THE INVENTION

In a preferred embodiment, an apparatus for excluding debris during a downhole wet-mate connection is presented. The apparatus includes a first downhole assembly having a housing, a first connector attached to the housing, a first communication line attached to the first connector, and a reciprocating cover member mounted for sliding engagement with the first housing. A second downhole assembly is provided, having a housing, a connector attached to the housing, a communication line having a free end attached to the connector, and a bladder cover member attached to the housing. The reciprocating cover member is moveable between a closed position, wherein the free end of the communication line is substantially enclosed, and an open position in which the free end of the communication line is exposed. The reciprocating cover member is moved in response to contact with the second downhole assembly. The bladder cover member is movable between a closed position, in which the bladder cover member substantially closes an otherwise open end of a housing chamber defined in the second downhole assembly, and an open position, wherein the bladder cover member is moved to open the open end of the housing chamber. The bladder cover member is moved to the open position by contact with the reciprocating cover member of the first downhole assembly. The reciprocating cover member can be biased towards the closed position by a spring element. The reciprocating cover member is preferably slidably mounted on the housing, such as slidably mounted on a cylindrical extension of the housing. The reciprocating cover member is preferably operable to move the bladder cover member to the open position. The reciprocating cover member is preferably operable to, prior to moving to an open position, move into the housing chamber. The housing chamber and the reciprocating cover member are preferably filled with a clean fluid, such as a dielectric fluid. The reciprocating cover member is preferably operable to move in response to relative movement of the first and second downhole assemblies. The housing of the second downhole assembly can define a surface for contacting and moving the reciprocating cover member axially. In a preferred embodiment, the connector of the first assembly is operable, in response to movement of the reciprocating cover member, to force open the reciprocating cover member. The bladder cover member can have pre-formed cuts, be made of elastomeric material, be spring biased toward the closed position, etc. The reciprocating cover member is preferably made of metal or other material stronger than the bladder cover. The reciprocating cover member is preferably biased towards a closed position. Additionally, the apparatus can include clean fluid reservoirs for re-filling the housing chamber and/or reciprocating cover member upon disconnection of the communication lines. The apparatus can provide clean fluid to the housing chamber or reciprocating cover member in response, for example, to suction pressure created during disconnection of the assemblies.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores. As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

Figure 1:
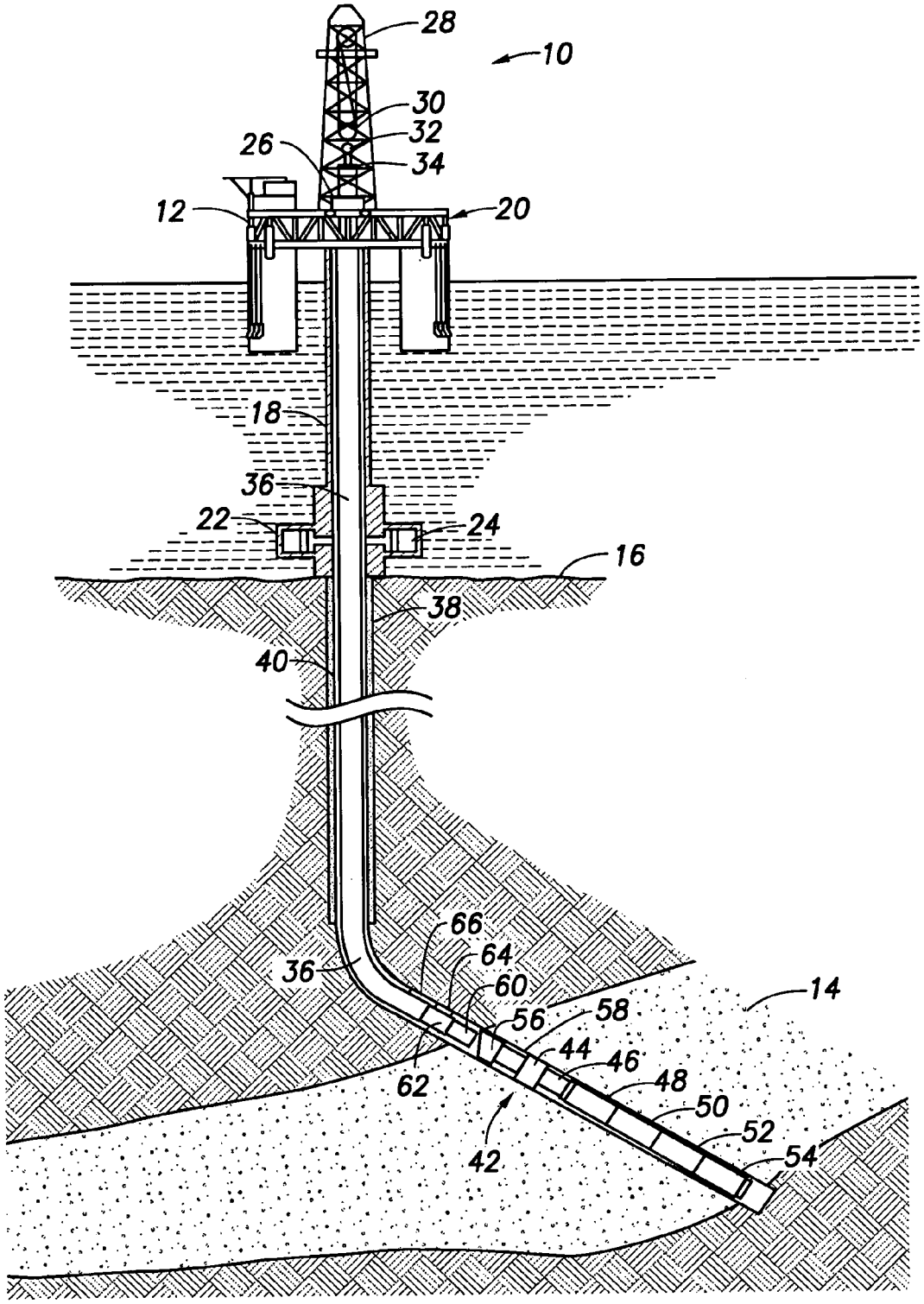
FIG. 1 is a schematic illustration of an offshore oil and gas platform operating an apparatus for protecting Points of Interest, such as fiber optic connectors, during connection of downhole connectors according to an embodiment of the present invention.

Referring to FIG. 1, an apparatus for controlling the connection speed of downhole connectors deployed from an offshore oil or gas platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending production tubing 36.

A wellbore 38 extends through the various earth strata including formation 14. An upper portion of wellbore 38 includes casing 40 that is cemented within wellbore 38. Disposed in an open hole portion of wellbore 38 is a completion string 42 that includes various tools such as packer 44, a seal bore assembly 46 and sand control screen assemblies 48, 50, 52, 54. In the illustrated embodiment, completion string 42 also includes an orientation and alignment subassembly 56 that houses a downhole wet mate connector. Extending downhole from orientation and alignment subassembly 56 is a conduit 58 that passes through packer 44 and is operably associated with sand control screen assemblies 48, 50, 52, 54. Preferably, conduit 58 is a spoolable metal conduit, such as a stainless steel conduit that may be attached to the exterior of pipe strings as they are deployed in the well. In the illustrated embodiment, conduit 58 is wrapped around sand control screen assemblies 48, 50, 52, 54. One or more communication media such as optical fibers, electrical conducts, hydraulic fluid or the like may be disposed within conduit 58. In certain embodiments, the communication media may operate as energy conductors including power and data transmission between downhole a location or downhole sensors (not pictured) and the surface. In other embodiments, the communication media may operate as downhole sensors.

For example, when optical fibers are used as the communication media, the optical fibers may be used to obtain distributed measurements representing a parameter along the entire length of the fiber such as distributed temperature sensing. In this embodiment, a pulse of laser light from the surface is sent along the fiber and portions of the light are backscattered to the surface due to the optical properties of the fiber. The slightly shifted frequency of the backscattered light provides information that is used to determine the temperature at the point in the fiber where the backscatter originated. In additions as the speed of light is constant, the distance from the surface to the point where the backscatter originated can also be determined. In this manner, continuous monitoring of the backscattered light will provide temperature profile information for the entire length of the fiber.

Disposed in wellbore 38 at the lower end of production tubing string 36 are a variety of tools including seal assembly 60 and anchor assembly 62 including downhole wet mate connector 64. Extending uphole of connector 64 is a conduit 66 that extends to the surface in the annulus between production tubing string 36 and wellbore 38 and is suitable coupled to production tubing string 36 to prevent damage to conduit 66 during installation. Similar to conduit 58, conduit 66 may have one or more communication media, such as optical fibers, electrical conducts, hydraulic fluid or the like disposed therein. Preferable, conduit 58 and conduit 66 will have the same type of communication media disposed therein such that energy may be transmitted therebetween following the connection process. As discussed in greater detail below, prior to producing fluids, such as hydrocarbon fluids, from formation 14, production tubing string 36 and completion string 42 are connected together. When properly connected to each other, a sealed communication path is created between seal assembly 60 and seal bore assembly 46 which establishes a sealed internal flow passage from completion string 42 to production tubing string 36, thereby providing a fluid conduit to the surface for production fluids. In addition, as discussed in greater detail below, the present invention enables the communication media associated with conduit 66 to be operatively connected to the communication media associated with conduit 58, thereby enabling communication therebetween and, in the case of optical fiber communication media, enabling distributed temperature information to be obtained along completion string 42 during the subsequent production operations.

Even though FIG. 1 depicts a slanted wellbore, it should be understood by those skilled in the art that the apparatus for controlling the connection speed of downhole connectors according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the apparatus for controlling the connection speed of downhole connectors according to the present invention is equally well suited for use in onshore operations. Further, even though FIG. 1 depicts an open hole completion, it should be understood by those skilled in the art that the apparatus for controlling the connection speed of downhole connectors according to the present invention is equally well suited for use in cased hole completions.

Figure 2:
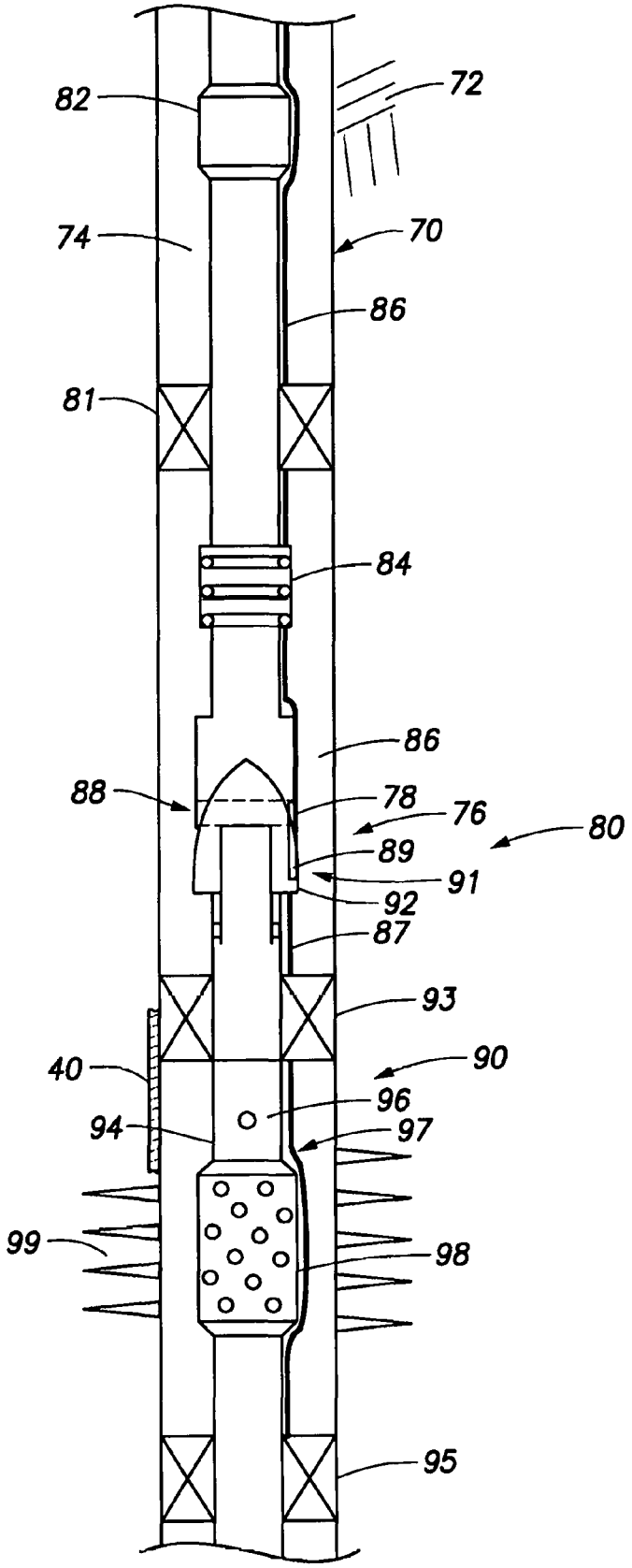
FIG. 2 is a schematic view of a wellbore extending through a subterranean formation, a well tool string positioned therein, and having an exemplary wet-connect connection system according to an aspect of the invention.

FIG. 2 is a schematic view of a wellbore 70 extending through a subterranean formation 72, a well tool string 74 positioned therein and having an exemplary wet-connect connection system 80 according to an aspect of the invention. The tool string includes a sub-surface safety valve (SSSV) 82 positioned below a wellhead (not shown). Below the SSSV is any number of string segments to desired length. A travel joint 84 releasably connects to an anchoring device 86 having an anchor head 88. An upper wet-mate connector assembly 76 with multiple upper wet-mate connectors 78 is positioned at the lower end of the work string. The upper wet-mate connector can be positioned in or adjacent the anchor head. Packers 81 isolate the lower end of the tool string from the wellbore annulus above. An exemplary communication line 86 or cable is shown extending along the length of the tool string from the surface, through the travel joint, and to the anchor device and wet-mate connector assembly. The communication line can be one or multiple lines or cables, fiber optic, electrical, etc. The line or lines can be positioned exterior to the tool string, as shown, interior, in a dedicated conduit, etc.

The tool string shown is schematic only, lacking details such as joints, tubing sections, additional tools, lines, sealing devices, etc., is not to scale, does not attempt to show all of the tools and sections typically used in such a work string, and is exemplary, as the tool string can have fewer or more tools, in various arrangements, as is known in the art. The wellbore can be cased, cemented, and at various stages of preparation, stimulation, production, etc. Further, the wellbore can be vertical, deviated or horizontal.

The tool string 74 is shown lowered into position above a lower tool assembly 90 positioned at a downhole location in the wellbore. The exemplary lower tool assembly 90 includes a scoop head assembly 92, an isolated tubing section 94, a circulating valve 96, screen assembly 98 adjacent perforated region 99, and sensors, gauges, data transmission systems, and other downhole electronic equipment 97. The region 99 is isolated by annular barriers such as sump packer 95 and packer 93. The lower tool assembly is held in position by packers, anchoring devices, or the like. The lower assembly shown is exemplary and schematic only and may include additional or differing tools and configurations as are known in the art. The scoop head assembly 92 is designed to connect to the anchor head of the tool string 74. A lower wet-mate connector assembly 91 with multiple lower wet-mate connectors 89 is positioned at the upper end of the lower tool assembly 90. The lower wet-mate connector can be positioned in or adjacent the scoop head assembly. The lower wet-mate connector maintains the positioning of a free end of lower communication cable or line 87.

As the tool string 74 is lowered into position above the lower tool assembly 90, the anchor head assembly aligns with and contacts the scoop head assembly. Further movement of the tool string downward results in contact and connection of the upper and lower wet-mate connectors, thereby allowing communication between downhole equipment and the surface. The details of the connection are discussed herein in exemplary embodiments including apparatus and methods for executing a clean connection between wet-mate connectors.

The invention described herein is generally discussed in terms of providing for protected connections or connectors of fiber optic cables or lines. Such terms are used to generically refer to communications cables, wires, lines, conduits, etc., including fiber optic, copper or other metal, hydraulic, etc. The term "Point of Interest" is used to refer to the end of the communication line which is to be connected to a corresponding end of another line, or to the line end and connector or connector body holding the line end. In FIG. 2, for example, the Points of Interest 78 and 89 are the connectors holding the free ends of the upper line 86 and lower line 87.

Figure 3:
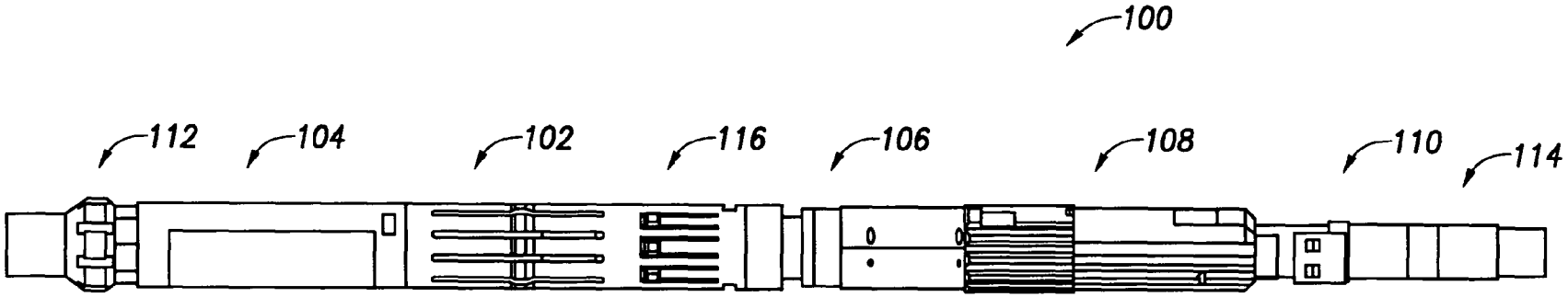
FIG. 3 is a side view schematic of an upper tool assembly 100 having an embodiment of a reciprocating debris exclusion assembly according to an aspect of the invention.

FIG. 3 is a side view schematic of an upper tool assembly 100 having an anchoring assembly 102 for anchoring the tool assembly to a lower tool assembly positioned downhole (such as a completion or production string), metering assembly 104 for controlling speed of connection and disconnection of the upper and lower tool assemblies, anchor head load assembly 106 for applying load on the anchor head against the lower tool assembly after setting, an anchor head assembly 108 housing the upper wet connectors, an operation locking assembly 110 for engaging the lower connector subassembly (of the lower tool assembly) and locking against relative movement in production or operation mode, and a RIH locking assembly 116 for maintaining the relative position of tool elements during RIH. Upper and lower subs 112 and 114 are seen for connecting the tool assembly to, respectively, a work string, wireline or other conveyance, and to the lower tool assembly positioned in the wellbore. Details of the assemblies are discussed herein.

Figure 4:
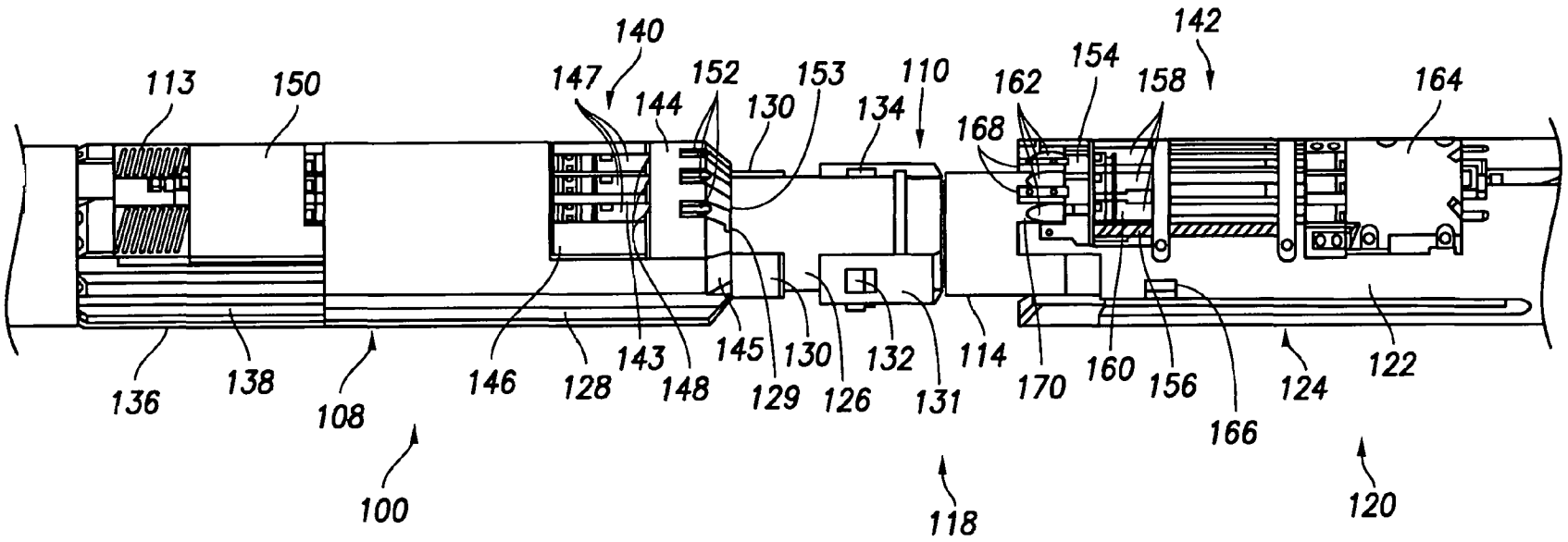
FIG. 4 is a side view detail schematic of an exemplary embodiment of the invention of a reciprocating debris exclusion system according to an aspect of the invention.
Figure 5A:
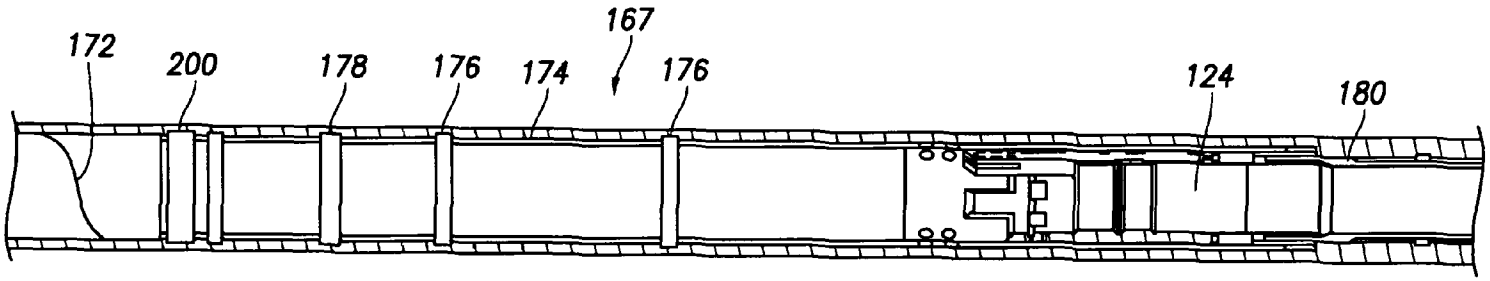
FIGS. 5A-B are schematic views of a lower tool assembly according to an aspect of the invention.
Figure 5B:
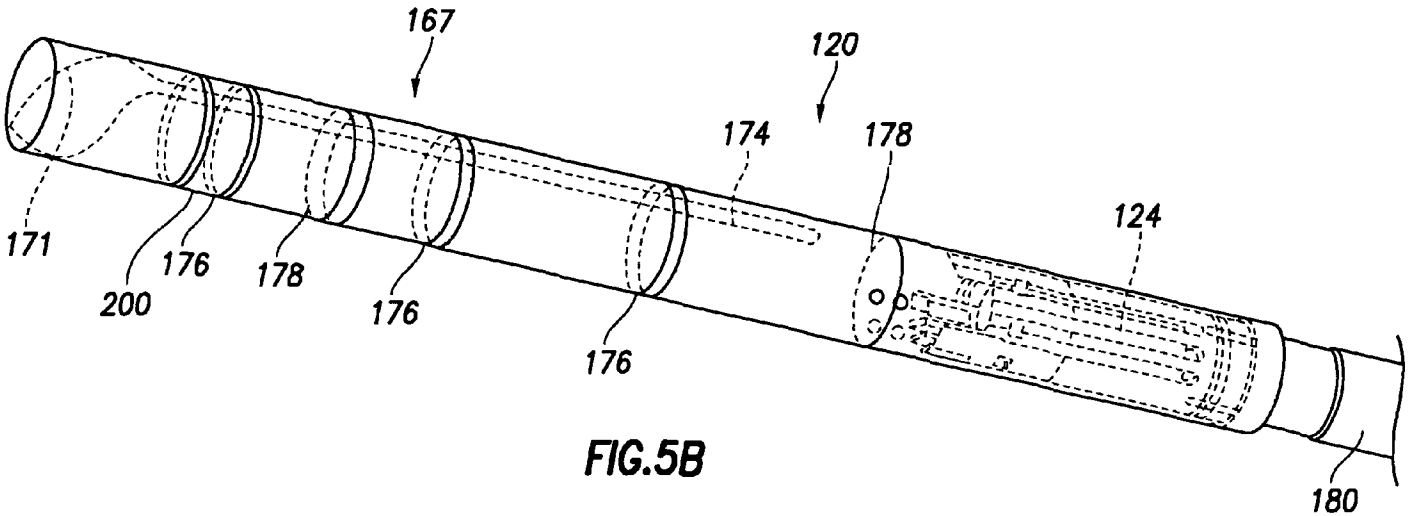

FIG. 4 is a side view detail schematic of an exemplary embodiment of the invention (with selected external components (e.g., housings) removed to allow a view of interior components) of a reciprocating debris exclusion system 118 according to an aspect of the invention. The upper tool assembly 100 is seen in initial cooperation with lower tool assembly 120. Lower sub 114, preferably a sealing sub, telescopes into the mandrel 122 of lower tool assembly 120 upon running-in the upper tool assembly. The lower sub 114 enters the scoop or alignment head 167 of the lower tool assembly, as seen in FIGS. 5A-B.

The anchor head assembly 108 preferably houses the upper components of the reciprocating debris exclusion assembly while the lower cooperating components of the reciprocating debris exclusion assembly are preferably housed in a top sub 124 of the lower tool assembly 120. The upper tool assembly has a mandrel 126 on which is slidably mounted the anchor head assembly 108, including anchor head 128. The anchor head 128 defines longitudinally downwardly extending props 130 which cooperate with the operation locking assembly 110. The operation locking assembly 110 includes an operation locking body 131 with locking keys 132 mounted thereon which cooperate with corresponding key windows 134 in the locking assembly. The locking keys are unsupported during run-in.

The upper tool assembly also includes an alignment subassembly 136 with exterior longitudinally extending alignment lug 138 which interacts with the slot 174 of the scoop head of the lower tool assembly 120 to rotate the upper tool assembly to the preferred alignment during insertion into the lower tool assembly.

The reciprocating debris exclusion assembly 118 includes an upper reciprocating subassembly 140 mounted on the upper tool assembly 100 and a lower reciprocating subassembly 142 mounted on the lower tool assembly 120.

The upper reciprocating subassembly 140 includes a slidably mounted connector block 144 which slides longitudinally within recess 146 defined in anchor head 128. The upper connector block 144 contacts lug 143 which is fixedly attached to, or extends from, the mandrel 126. The upper fiber optic lines are carried in upper connectors 147, one for each fiber optic line. The upper connectors 147 are slidably mounted to the anchor head 128 and extend from the splicer block 150 and through corresponding holes 148 in reciprocating connector block 144. The splicer block 150 is spring biased, such as by biasing elements 113, shown as springs.

Protective covers 152 are mounted on the reciprocating block 144 and positioned to cover the free ends of the connectors 147 (and the line ends held thereby) during run-in and prior to connection. The covers 152 are preferably biased by biasing elements towards a closed position, as seen in FIG. 4. Note that the "splicer block" is so-called here since it contains the splicer in addition to its function in supporting the connectors and reciprocating, preferably with a spring bias. The block is a reciprocating or sliding block with attached one or more connectors; it need not necessarily act as a splicer, where only one connector is used or where the splicing occurs at another location. A preferred cover assembly is discussed below.

Figure 14:
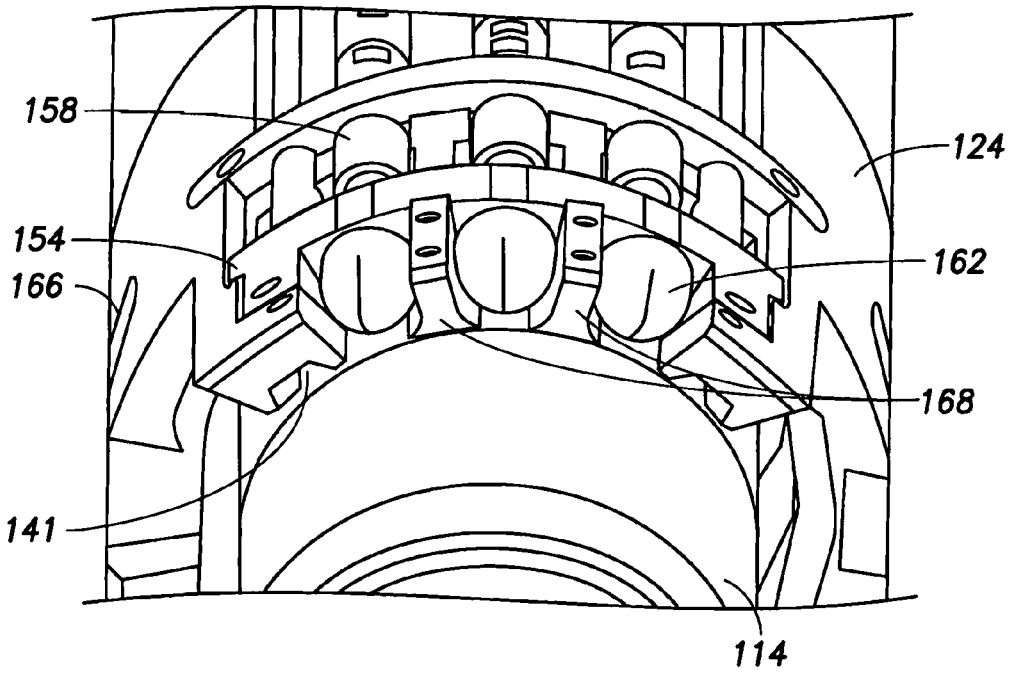
FIG. 14 is an orthogonal end view schematic of the lower reciprocating block.

The upper reciprocating connector block 144 defines at its lower end a plurality of longitudinally downward extending lugs 153 which cooperate with corresponding guides 168 in the top sub 124 of the lower tool assembly 120. The anchor head 128 has longitudinally extending lugs 129 which extend under the reciprocating block 144 and cooperate, in use, with corresponding channels 141 defined in the interior surface of the top sub 124 of the lower tool assembly, as best seen in FIG. 14. In use, the lugs 129 slide into the channels, radially interior to the top sub, as the upper assembly is lowered into contact the top sub. The lugs 129 contact corresponding faces 170 defined on the upper end of the lower reciprocating block 154, forcing the lower block to move longitudinally downward. Further, the anchor head has "no-go" or lug faces 145 which cooperate with corresponding no-go faces 172 defined on the upper end of the top sub 124. The anchor head no-go faces 145 contact the corresponding top sub no-go faces 172 after or during full mating of the upper and lower connectors.

It is understood that one or more communication lines can be used, and that a single line from the surface can be split using conventional splitters into multiple lines at or near the lower end of the work string. For example, the multiple connectors 147 each carry a length of fiber optic line for connection to corresponding lengths of line on the lower tool assembly. However, a single fiber optic line extends from the surface to a splitter positioned within splicer or splitter housing 150 on the upper tool assembly. Similarly, one or more lines can be run on the lower tool assembly, or a single line with splitters near the connection location. Splices can be used to merge lines as well, such as lines from various sensors on the lower tool assembly.

The lower reciprocating subassembly 142 includes a slidably mounted connector block 154 which slides longitudinally within a recess or between guides defined in the top sub 124 of the lower tool assembly 120. The lower connector block 154 is spring biased, such as by biasing elements 156, shown as springs, towards a closed position, as seen in FIG. 4, in which the Point of Interest, namely the ends of the fiber optic lines, is protected or covered. The lower fiber optic lines are carried in lower connectors 158, one for each fiber optic line. The lower connectors 158 are attached to top sub 124 of lower tool assembly 120 and extend through corresponding holes 160 in lower reciprocating connector block 154. Protective covers 162 are mounted on the reciprocating block 154 and positioned to cover the free ends of the connectors 158 (and the line ends held thereby) during run-in and prior to connection. The covers 162 are preferably biased by biasing elements towards a closed position, as seen in FIG. 4. A preferred cover assembly is discussed below. The top sub 124 can also include splicers, splitters, and other well-known communications components. For example, splitter or splicer housing 164 is seen at the lower end of the lower connectors.

The lower reciprocating assembly also includes an upper profile having a plurality of longitudinally extending guides 168 for contacting lugs 153 of the upper reciprocating block 144. Key holes 166 are defined in the top sub 124 for cooperating with locking keys 132 of the operation locking assembly 110 of the upper tool assembly 100. Channels 141 are defined on the interior surface of the top sub to receive and cooperate with lugs 129 of the anchor head.

FIGS. 5A-B are schematic views of a lower tool assembly according to an aspect of the invention. The lower tool assembly 120 is seen with selected transparent walls for ease of reference; also note that the scoop head is omitted from other Figures to better show coordination of the anchor head assembly 108 and the top sub 124. The lower tool assembly includes the top sub 124, as previously discussed, positioned within a scoop head assembly 167. The scoop head assembly 167 defines an interior helical guide 171 and longitudinal slot 174 for interacting with the alignment lug 138 of the alignment subassembly 136 of the upper tool assembly 100. Snap rings 176 provide scoop head rigidity. An internal unlocking profile 178 is defined for interaction with the unlocking collet of the run-in-hole locking assembly 116 of the upper tool assembly 100. A splice sub 180 is seen on the lower tool assembly as well.

Figure 6:
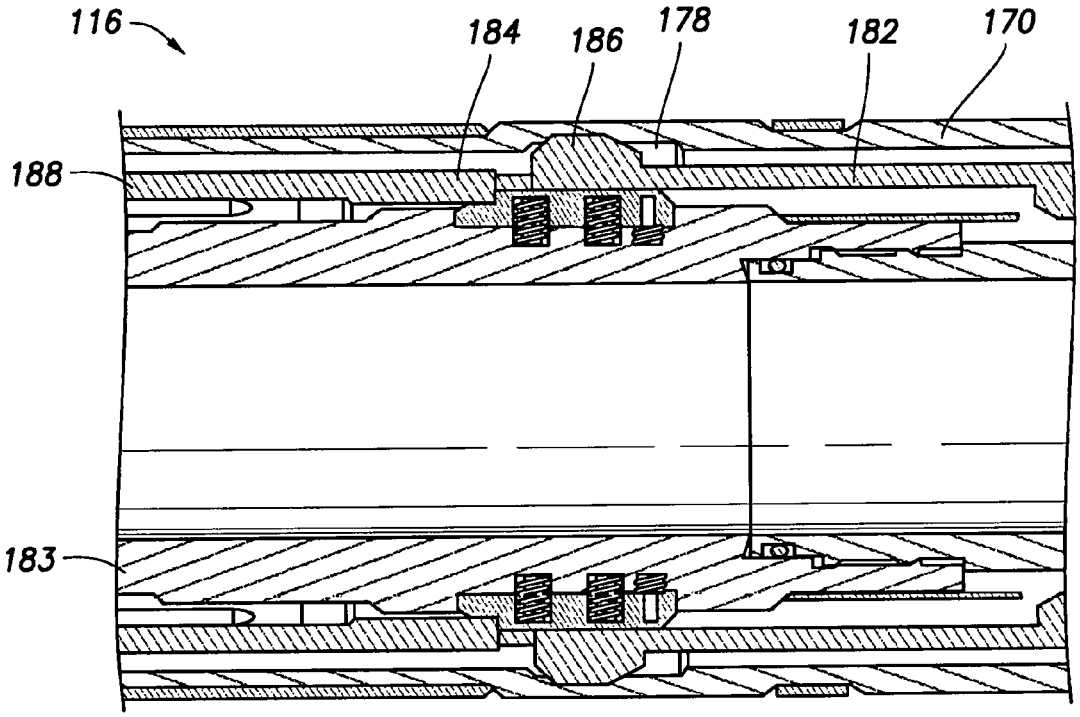
FIG. 6 is cross-sectional detail view of an exemplary unlocking assembly according to an aspect of the invention.

FIG. 6 is cross-sectional detail view of an exemplary unlocking assembly according to an aspect of the invention. The locking assembly 116 includes a locking collet 182 positioned about a locking assembly mandrel 183. The spring-loaded locking keys 184 are positioned between the collet and mandrel initially in a radially expanded and locked position during run-in. The keys cooperate with the surfaces of the locking collet 182 and sleeve 188 of the anchoring assembly 102 to lock the anchor assembly and prevent accidental stroke during run-in. The locking collet 182 enters the scoop head assembly 167 and collet dogs 186 cooperate with internal unlocking profile 178. The collet 182 depresses the spring-loaded locking keys 184 thereby freeing the anchoring assembly 188 to slide respective to the mandrel 183.

Figure 7:
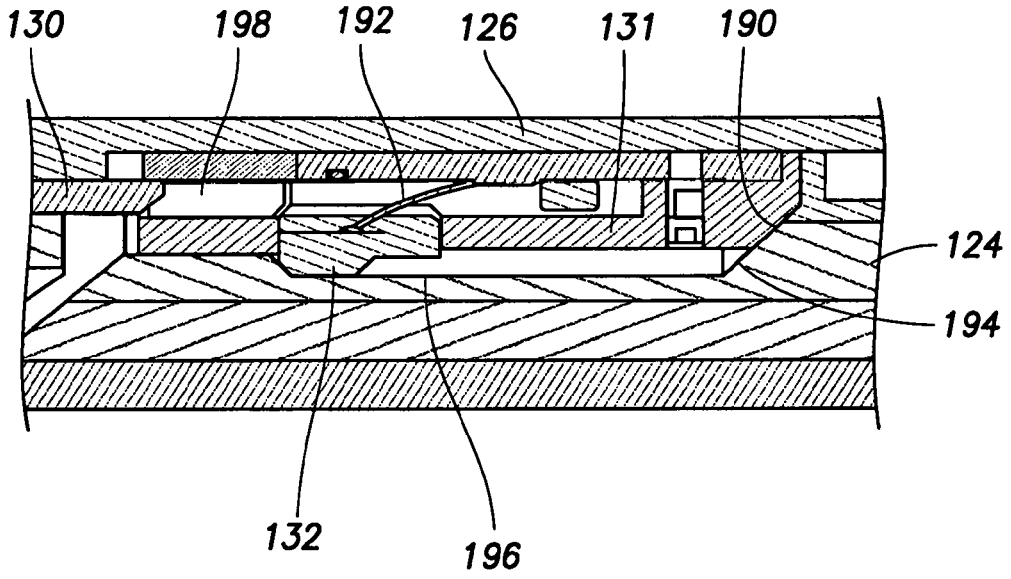
FIG. 7 is a cross-sectional detail schematic of an exemplary embodiment of an operation locking assembly according to an aspect of the invention.

FIG. 7 is a cross-sectional detail schematic of an exemplary embodiment of an operation locking assembly 110 according to an aspect of the invention. The operation locking assembly 110 is seen in detail having a locking body 131 with a no-go surface 190 at its lower end. Locking keys 132 are supported by internal biasing members 192 such that the keys are biased radially outwardly. As the upper tool assembly is lowered, the locking body no-go surface 190 contacts a cooperating no-go surface 194 defined on the interior surface of the top sub 124. The locking keys 132 are forced radially outwardly into a top sub internal profile 196. The locking keys 132 extend through the key windows 166 of the top sub 124 (seen in FIG. 4). Note that the keys are unsupported as the prop 130 of the anchor head 128 have not yet slid into channel 198 defined between the interior of the locking body and the mandrel 126. A radially extending pin 133 connects locking body 131 with a key 135 which locks into slot 137 on mandrel 126 to prevent relative rotation between the mandrel and locking body.

Figure 8:
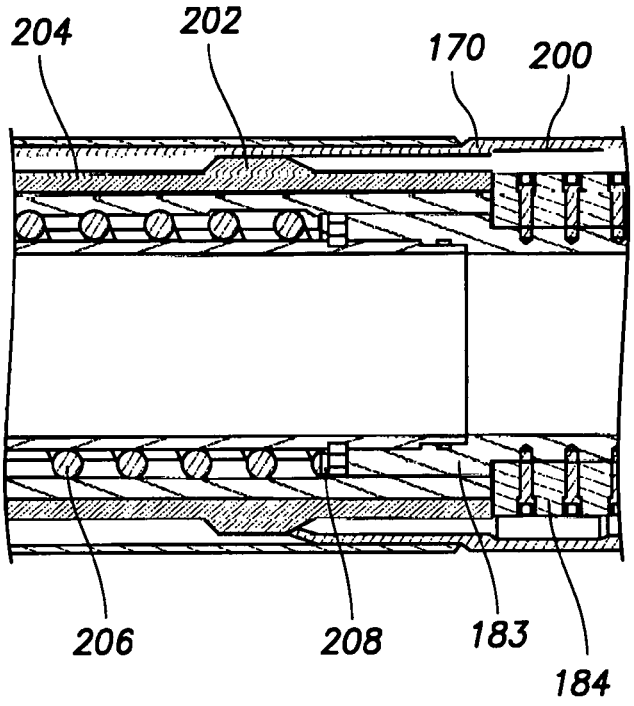
FIG. 8 is a cross-sectional detail schematic of an exemplary anchoring assembly 102 according to an aspect of the invention

FIG. 8 is a cross-sectional detail schematic of an exemplary anchoring assembly 102 according to an aspect of the invention. Internal profile 200 of the scoop head 167 cooperates with dogs 202 of anchoring assembly collet 204 as the upper tool assembly continues to be lowered into the scoop head. Once set, the anchoring collet 204 secures the upper tool assembly to the lower tool assembly. Also visible is the anchoring re-setting spring 206 which is compressed against the upper shoulder 208 of the locking assembly mandrel 183 during metering of the metering assembly. The resetting spring operates to re-set the assembly upon disconnection.

Figure 9:
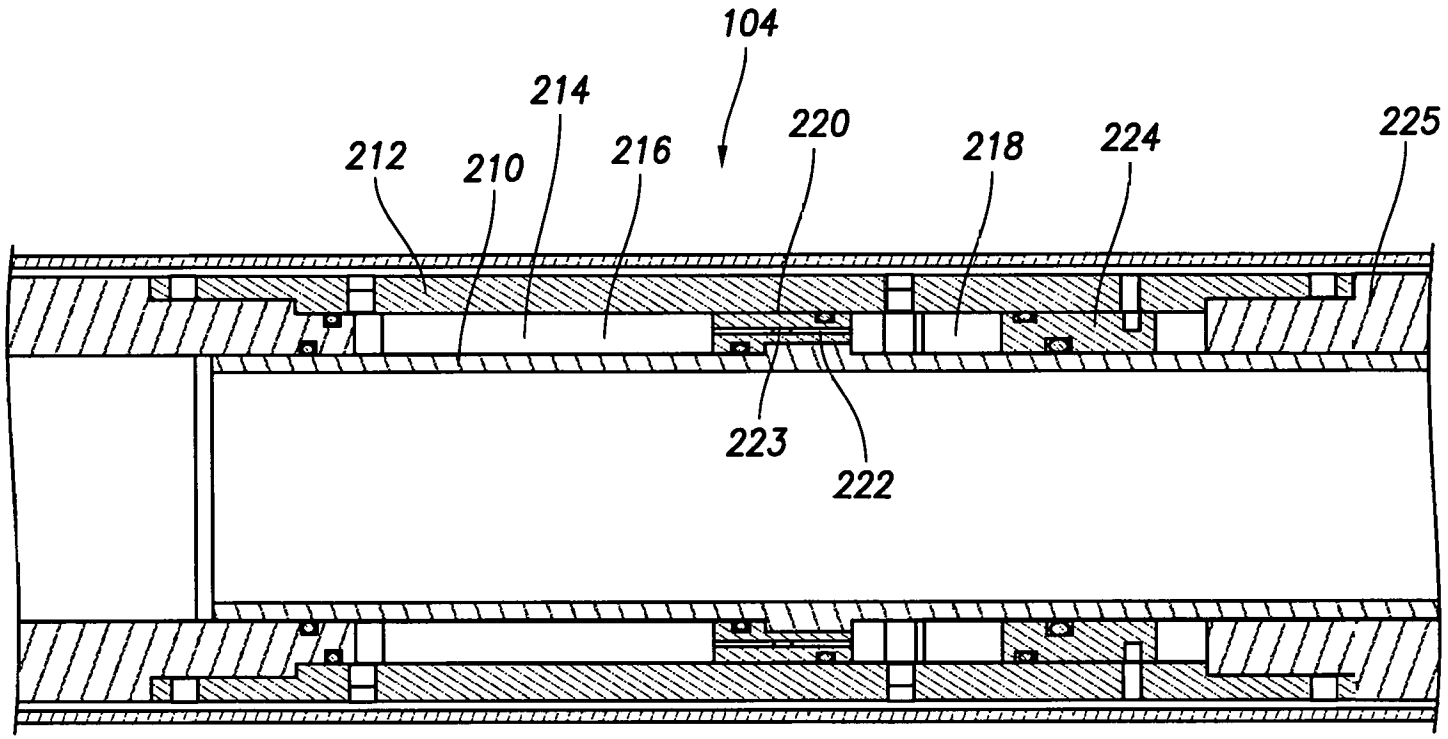
FIG. 9 is a cross-sectional detail schematic of a metering assembly according to an aspect of the invention.

FIG. 9 is a cross-sectional detail schematic of a metering assembly according to an aspect of the invention. At its upper end, the upper tool assembly 100 includes a metering assembly 104 having a slidable metering mandrel 210. Disposed between metering mandrel 210 and exterior tubular 212 is annular oil chamber 214 having an upper section 216 and lower section 218. Transfer piston 220 is positioned in the annular chamber and includes one or more passageways 222 therethrough, the passageways preferably having metering orifices 223 which regulate fluid flow rates. In one embodiment, a check valve is disposed in each passageway 222 to limit fluid flow to one direction. In one embodiment, certain check valves allow fluid flow in the uphole direction while other check valves allow fluid flow in the downhole direction. The resistance to flow in the downhole direction can be different from the resistance to flow in the uphole direction. The metering function of the passageways and orifices determines the speed of coupling and decoupling of the downhole connectors. Disposed within annular oil chamber 214 is compensation piston 224. At its lower end, exterior tubular 212 is connected to connector member 225. At its lower end, metering mandrel 210 is threadedly and sealingly coupled to the upper end of a key block 183, discussed herein.

As the anchor starts metering, that is, as hydraulic fluid is transferred from the upper chamber 216 to the lower chamber 218, the resetting spring 206 is compressing. Metering is started by setting down weight on the upper tool assembly through the work string. For example, a set-down weight of 10 k pounds can be used to start metering the anchor. When crack relief pressure is reached, the anchor begins collapsing and the resetting spring is compressed. The anchor continues metering, which pushes downwards on the external components until the anchor head no-goes against the top sub of the lower tool assembly.

For further disclosure as to the operation of the resetting spring and assembly, see U.S. Patent Application Publication No. 2012/0181045, to Thomas, filed Feb. 25, 2012.

Figure 10:
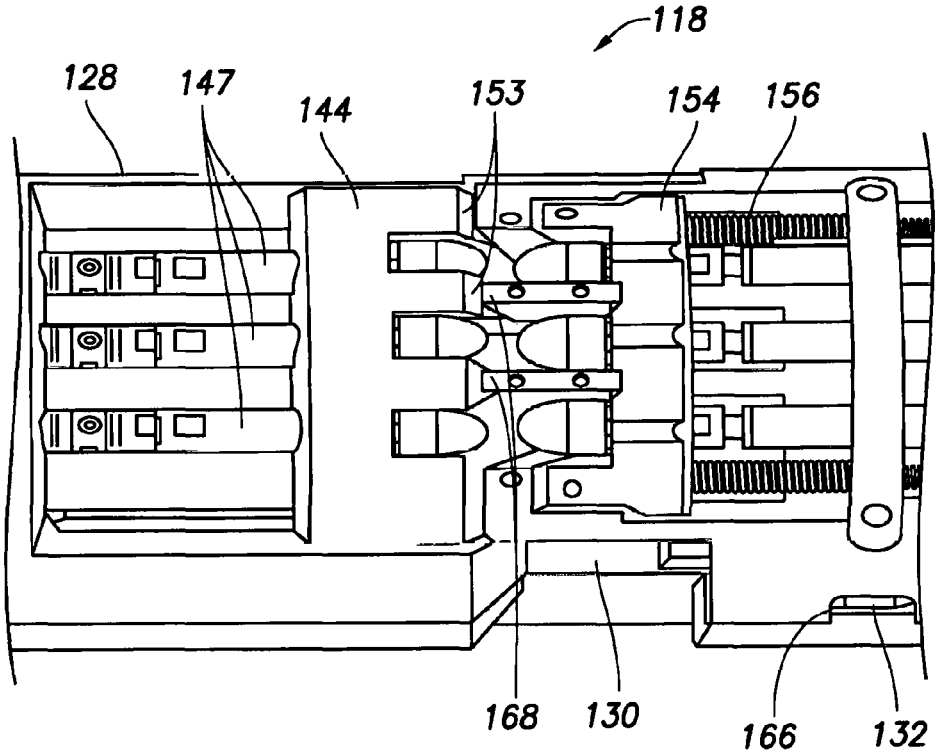
FIG. 10 is a detail schematic of the anchor head and reciprocating debris exclusion assembly according to an aspect of the invention.

FIG. 10 is a detail schematic of the anchor head and reciprocating debris exclusion assembly according to an aspect of the invention. In FIG. 10, a detail of the reciprocating debris exclusion assembly 118 is seen, with the anchor head 128 moved into a position such that the upper connector block 144 is in contact with the lower guides 168. More specifically, the plurality of longitudinally downward extending lugs 153 of the upper reciprocating connector block 144 are in contact with the cooperating and corresponding guides 168 of the top sub 124 of the lower tool assembly 120. The upper connector block is in a no-go position against the top sub. The downwardly extending props 130 of the anchor head 128 continue downward to cooperate with the operation locking assembly 110. Locking keys 132 of the locking body 131 are moved into position with respect to the key windows 134 in the locking assembly.

Figure 11:
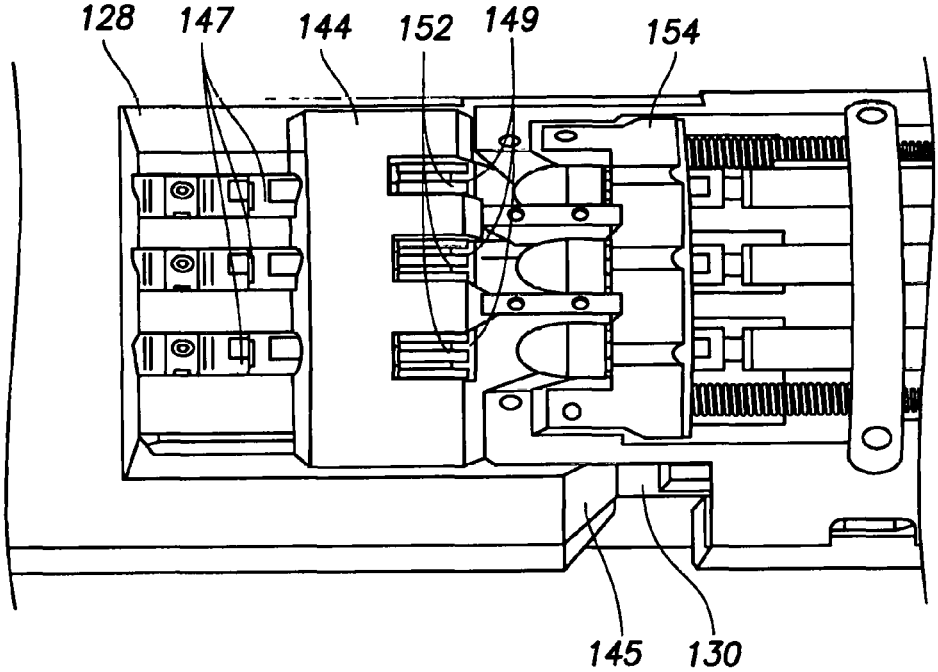
FIG. 11 is a detail schematic of the anchor head and reciprocating debris exclusion assembly according to an aspect of the invention.

FIG. 11 is a detail schematic of the anchor head and reciprocating debris exclusion assembly according to an aspect of the invention. The anchor head continues downward while the upper connector block 144 is held in position, causing relative movement between the block and anchor head. The upper connector block 144 slides in recess 146, the holes 148 in reciprocating connector block 144 allow the upper connectors 147 to maintain position, and the connector protective covers 152 are pulled along with upper block 144, thereby forcing the covers 152 to open revealing the free ends 149 of the connectors 147 and the fiber optic line ends held by the connectors. The longitudinally extending lugs 129 of the anchor head 128 extend into and cooperate with corresponding channels 141 defined in the interior surface of the top sub 124 of the lower tool assembly. Interior to the top sub 124, the prop 130 of the anchor head begin to slide under and support the locking keys 132.

Figure 12:
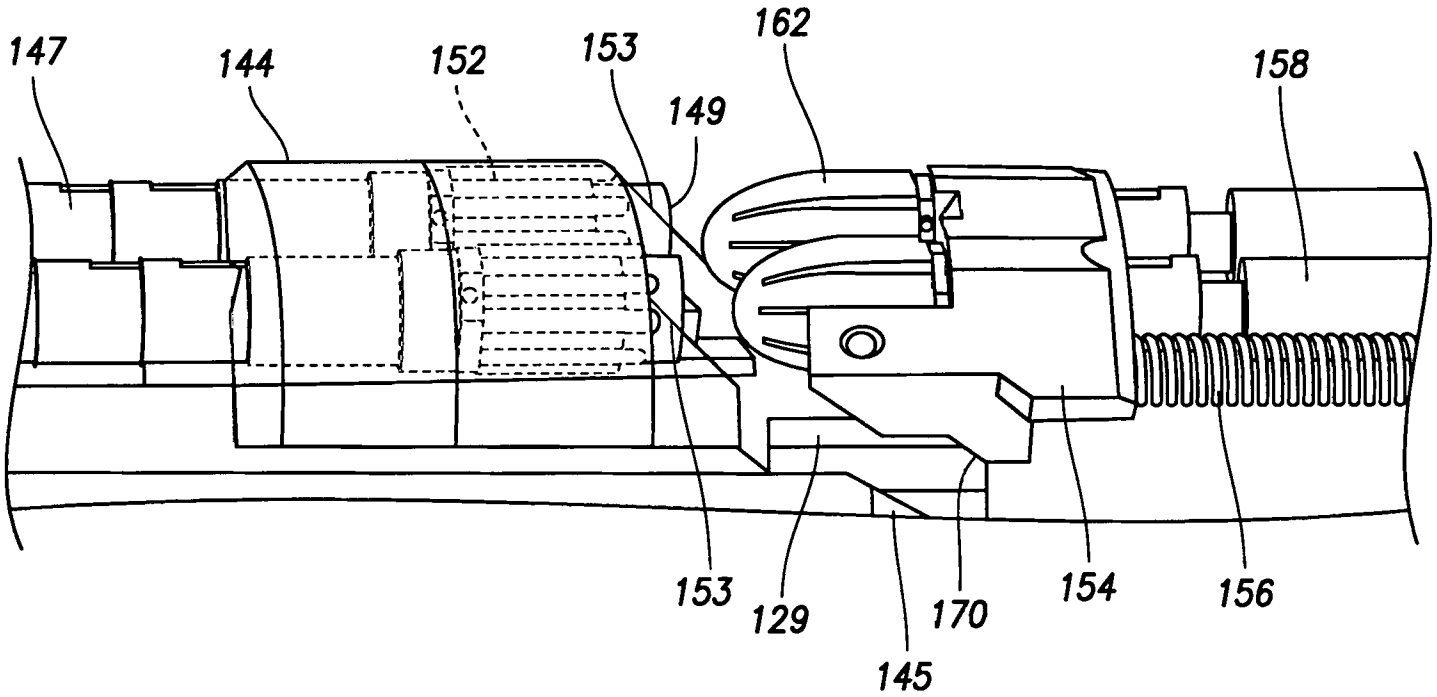
FIG. 12 is a detail, partial view schematic of the anchor head and reciprocating debris exclusion assembly according to an aspect of the invention in which the lower debris exclusion assembly is in position to be opened.

FIG. 12 is a detail, partial view (with top sub 124 removed), schematic of the anchor head and reciprocating debris exclusion assembly according to an aspect of the invention in which the lower debris exclusion assembly is in position to be opened. FIG. 12 shows the lugs 129 of the anchor head contacting corresponding lower connector block faces 170 defined at the upper end of the lower connector block 154. As the anchor head continues its downward stroke, the lugs 129 force the lower reciprocating block 154 to move longitudinally downward. Movement of the block 154 pulls the attached covers 162 downward, thereby exposing the ends of the lower connectors 158 and the free ends of the fiber optic lines. Biasing element 156 is compressed by this movement as well, positioning the biasing element to force the lower connector block back upwards upon disconnect and removal of the anchor head.

Figure 13:
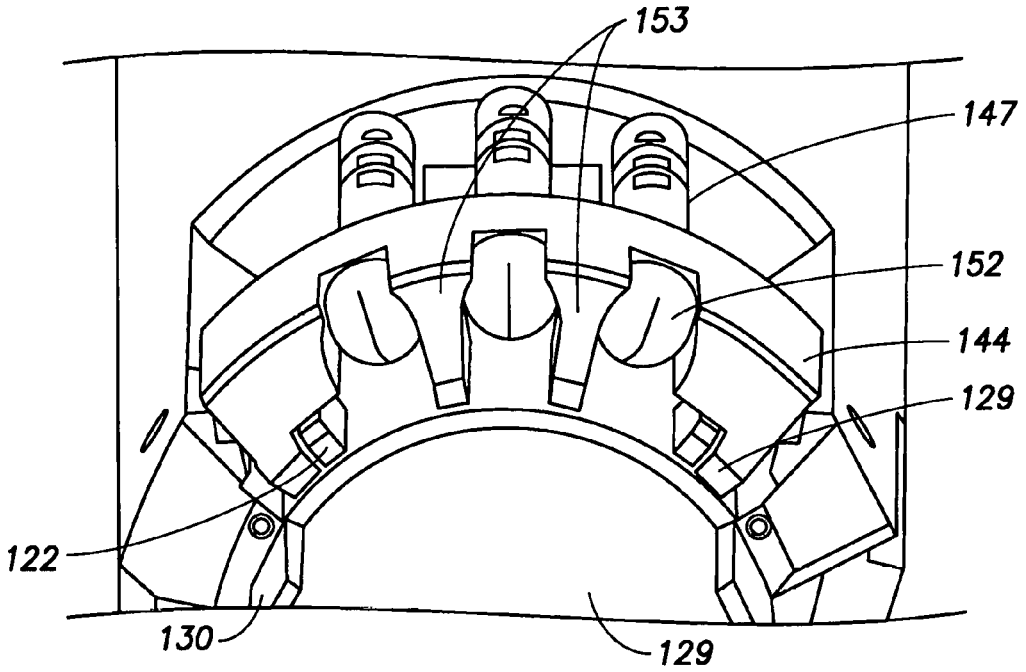
FIG. 13 is an orthogonal end view schematic of the upper reciprocating connector block.

FIG. 13 is an orthogonal end view schematic of the upper reciprocating connector block. FIG. 14 is an orthogonal end view schematic of the lower reciprocating block. FIGS. 13 and 14 provide another view of the cooperating elements of the upper connector block 144, the top sub 124, lower connector block 154, and anchor head 128. Detailed description of these assemblies is found elsewhere herein.

Figure 15:
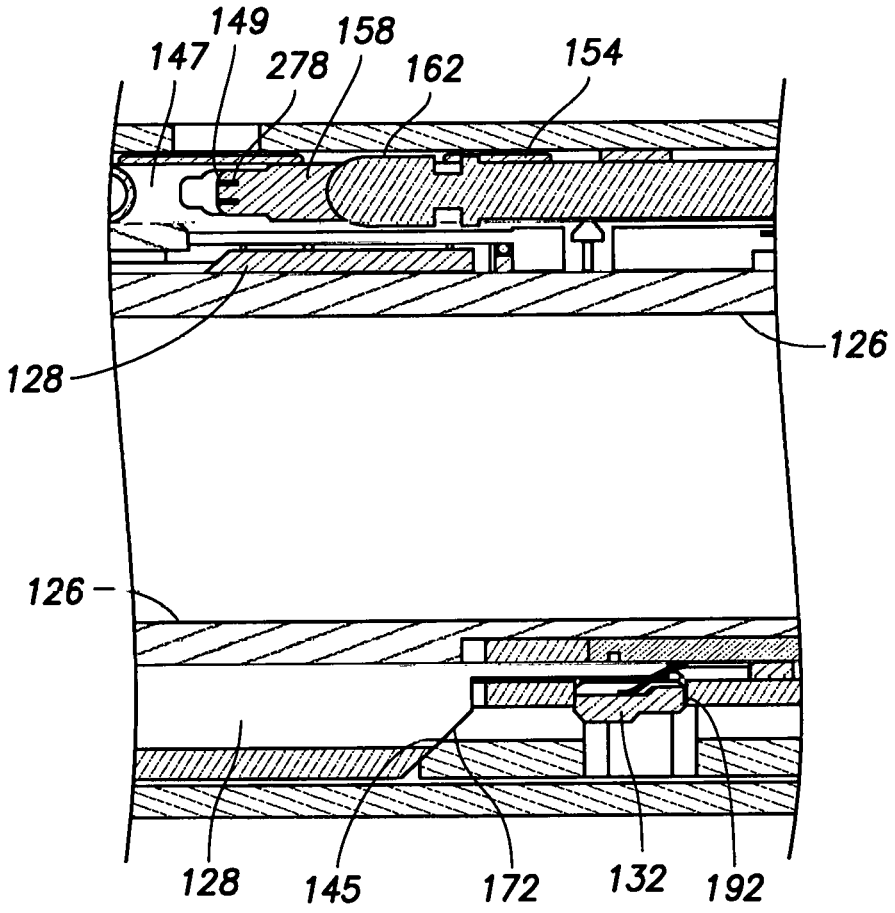
FIG. 15 is a detail cross-sectional schematic of the upper and lower connector assemblies in a mating position.

FIG. 15 is a detail cross-sectional schematic of the upper and lower connector assemblies in a mating position. As the anchor head moves downward, the no-go faces 145 of the anchor head contact the corresponding no-go faces 172 of the top sub 124. The upper and lower connectors 147 and 158 are fully mated. The anchor head prop 130 has slid beneath and supports the locking keys 132 in key window 166.

Figure 16:
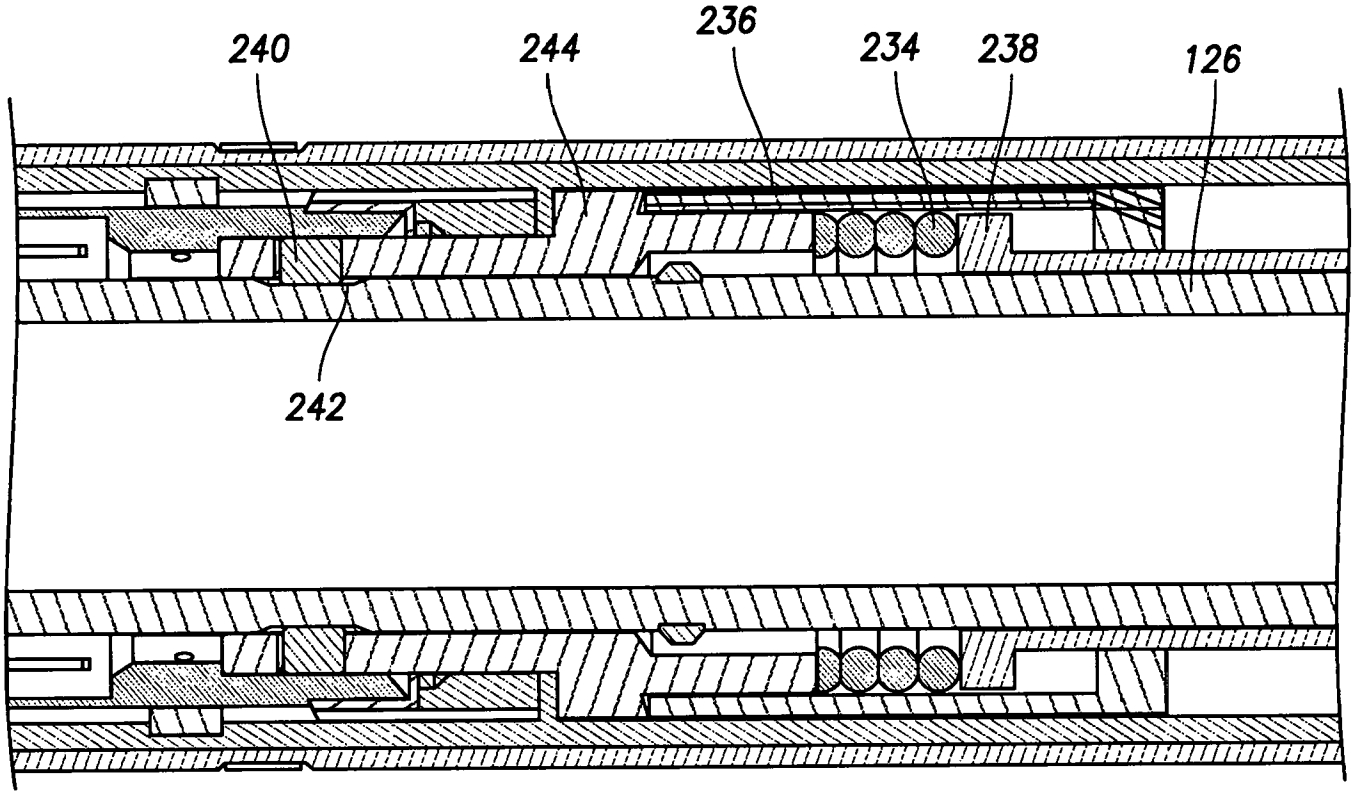
FIG. 16 is a detail cross-sectional schematic of the anchor head load assembly.

FIG. 16 is a detail cross-sectional schematic of the anchor head load assembly 106. Further disclosure of the operation of the locking collet, etc., can be found in the incorporated references. The anchor continues downward movement, with the metering assembly completing its metering, and large anchor collet 202 snaps into corresponding profile 200 defined on the interior of the top sub. As production spring 234 is compressed, spring housing 236 telescopes relative to connector member or sub 238. This shortening of the outer components of the anchor assembly allows spring key 240 to engage groove 242 of mandrel 126. Once spring key 240 has radially inwardly retracted, the outer components of the anchor assembly further collapse as the collet assemblies telescope relative to key mandrel 244. This shortening allows anchor collets 202 to engage locking profile 200 which couples the anchor assembly to the lower tool assembly. The shortening allows unlocking collets 186 to engage groove 178 which relaxes the unlocking collets. The inner portions of the anchor assembly are independently secured to the lower tool assembly as prop 130 on the lower end of the anchor head is positioned under locking key 132 such that locking key 132 engages profile 166 of top sub 124.

Figure 17:
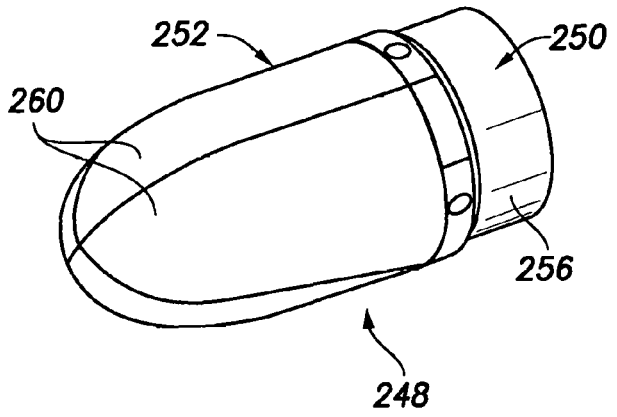
FIG. 17 is an orthogonal view of an embodiment of a debris exclusion cover assembly according to an aspect of the invention.
Figure 18:
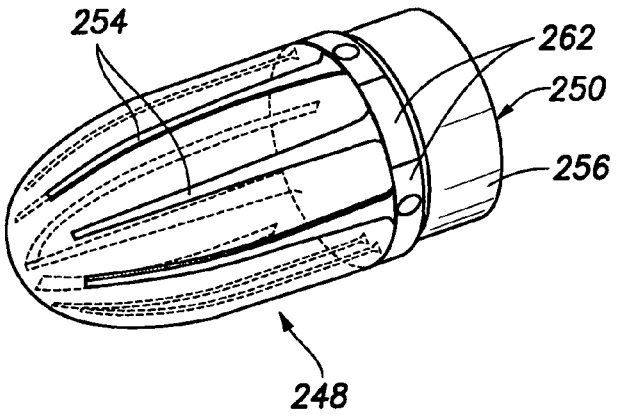
FIG. 18 is an orthogonal view of the debris exclusion cover assembly of FIG. 17 with a transparent cover to show internal features.

FIG. 17 is an orthogonal view of an embodiment of a debris exclusion cover assembly 248 according to an aspect of the invention. FIG. 18 is an orthogonal view of the debris exclusion cover assembly of FIG. 17 with a transparent cover to show internal features. The debris exclusion cover assembly 248 includes a base 250, a debris exclusion cover 252, and biasing elements 254. The base 250 allows attachment to the reciprocating block. In the preferred embodiment the base is a metallic tubular having a flange 256 for insertion into a mating cylindrical end of a connector. Attachment can be made by pins, screws, or other fasteners. The cover 252 is preferably a rubber, plastic or composite material that can withstand downhole environments. The cover can be a single piece divided by multiple longitudinally extending slits which allow the cover to open similar to a flower. Alternately, and as shown, the cover can be made of multiple pieces 260 shaped to abut one another when the cover is in the closed position. In a preferred embodiment, the cover is biased towards the closed position by one or multiple biasing elements 254. In the embodiment shown, longitudinally extending metal beams having a slight radially inward curve are seen. Each beam supports a corresponding cover piece 260. Each beam, at its lower end, is connected (or formed of-a-piece with) an element base 262. The base provides support for the beam and a manner of attachment of the biasing elements to the debris exclusion cover assembly base 250.

Figure 19:
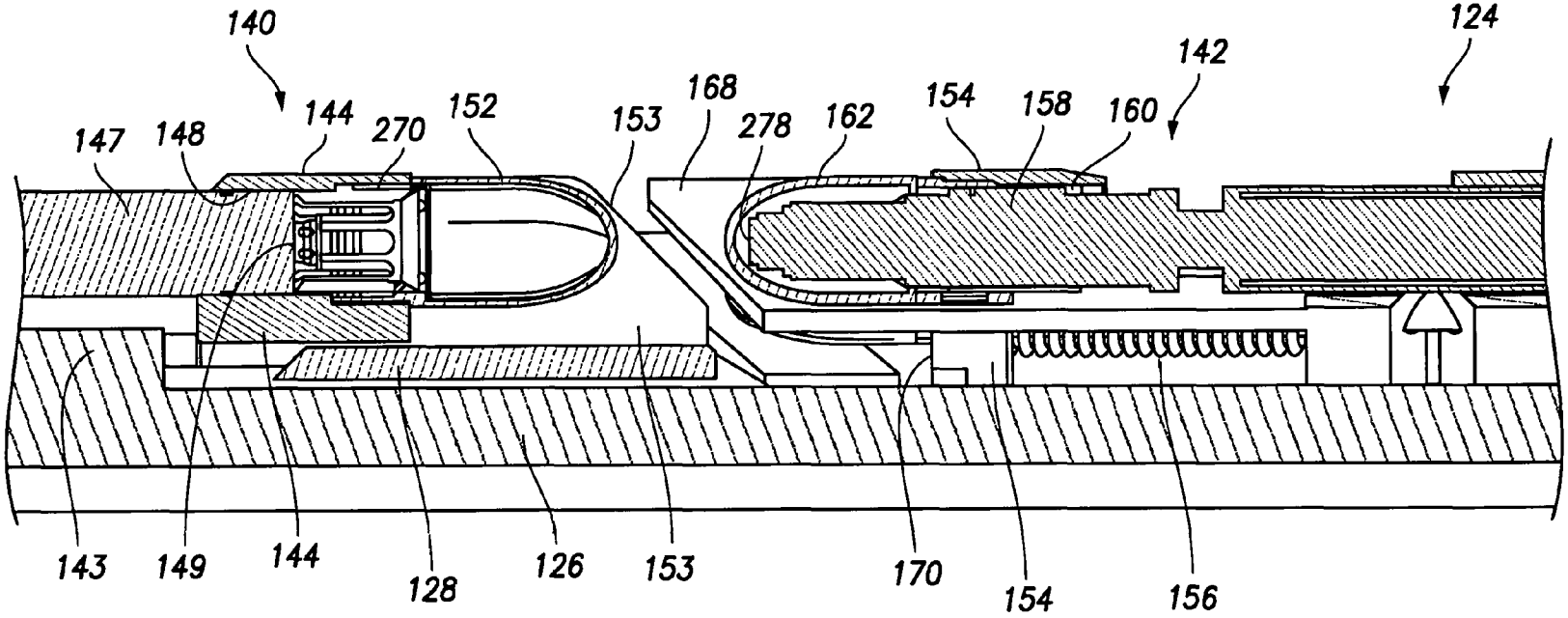
FIGS. 19 and 20 are detail cross-sectional views of an embodiment of a reciprocating debris exclusion assembly according to an aspect of the invention with FIG. 19 showing the debris exclusion assembly prior to mating and FIG. 20 showing the assembly in a mated position.
Figure 20:
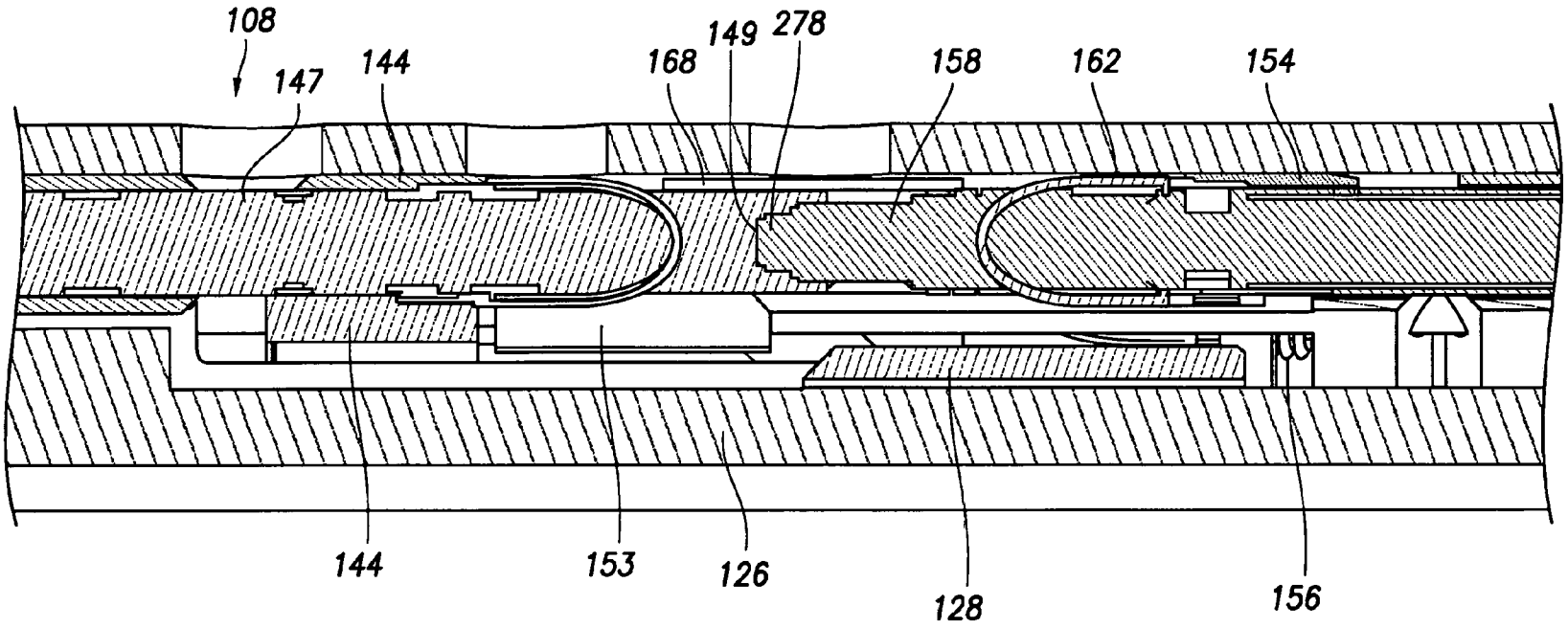

FIGS. 19 and 20 are detail cross-sectional views of an embodiment of a reciprocating debris exclusion assembly according to an aspect of the invention. FIG. 19 shows the debris exclusion assembly prior to mating while FIG. 20 shows the assembly in a mated position. Some elements are omitted to allow a better view of other elements under discussion here. Anchor head 128 is slidably mounted on mandrel 126. The reciprocating debris exclusion assembly includes an upper reciprocating subassembly 140 mounted on the upper tool assembly and a lower reciprocating subassembly 142 mounted on the lower tool assembly. The upper reciprocating subassembly 140 includes a slidably mounted connector block 144 which slides longitudinally within corresponding recess 146 defined in anchor head 128. The upper fiber optic lines are carried in upper connectors 147 (one seen here). The upper connectors 147 are slidably mounted to the anchor head 128 and extend from the splicer or reciprocating connector block and through corresponding holes 148 in reciprocating block 144. Protective covers 152 are mounted to the reciprocating block 144 at connection 270 and positioned to cover the free ends of the connectors 147 (and the fiber optic or other line ends held thereby) during run-in and prior to connection. The covers 152 are biased closed. The upper connector block 144 contacts lug 143 which is fixedly attached to, or extends from, the mandrel 126.

The upper reciprocating connector block 144 defines at its lower end a plurality of longitudinally downward extending lugs 153 which cooperate with corresponding guides 168 in the top sub 124. The anchor head 128 has longitudinally extending lugs 129 which extend under the reciprocating block 144 and cooperate with corresponding channels 141 defined in the interior surface of the top sub 124. The lugs 129 contact corresponding faces 170 defined on the upper end of the lower reciprocating block 154, forcing the lower block to move longitudinally downward. The anchor head has "no-go" or lug faces 145 which cooperate with corresponding no-go faces 172 defined on the upper end of the top sub 124 (not seen here).

The lower reciprocating subassembly 142 includes a slidably mounted connector block 154 which slides longitudinally within a recess or between guides defined in the top sub 124 of the lower tool assembly 120. The lower connector block 154 is spring biased by biasing elements 156 towards a closed position. The lower fiber optic lines are carried in lower connectors 158. The lower connectors 158 are attached to top sub 124 of lower tool assembly 120 and extend through corresponding holes 160 in lower reciprocating connector block 154. Protective covers 162 are mounted on the reciprocating block 154 and positioned to cover the free ends of the connectors 158 (and the line ends held thereby) prior to connection. The covers 162 are biased towards a closed position, as seen in FIG. 18. The lower reciprocating assembly also includes an upper profile having a plurality of longitudinally extending guides 168 for contacting lugs 153 of the upper reciprocating block 144. Key holes 166 are defined in the top sub 124 for cooperating with locking keys 132 of the operation locking assembly 110 of the upper tool assembly 100 (not seen here). Channel 141 is defined on the interior surface of the top sub to receive and cooperate with lugs 129 of the anchor head.

Anchor head 128 moves downward as upper connector block 144 is held in position by the upper profile of the top sub, causing relative movement between the block 144 and anchor head 128. The holes 148 in reciprocating connector block 144 allow upper connectors 147 to maintain position relative to the reciprocating block, and the connector protective covers 152 are pulled along with upper block 144, forcing the covers 152 to open revealing the free ends 149 of the connectors and fiber optic line ends. The longitudinally extending lug 129 of the anchor head 128 extends into corresponding channel 141 defined in top sub 124. Lug 129 of the anchor head contacts corresponding lower connector block face 170 defined at the upper end of the lower connector block 154. As the anchor head continues its downward stroke, the lug 129 forces the lower reciprocating block 154 to move downward. Movement of the block 154 pulls the attached covers 162 downward, thereby exposing the ends of the lower connectors and free ends 278 of the lower fiber optic lines. Biasing element 156 is compressed by this movement as well. The upper connectors 147 move relative to the mandrel 126 as production spring 234 pushes against sub 238 which itself is connected to the anchor head, as better seen in FIG. 16. The reciprocating block 144 slides relative to the anchor head and is prevented from continued downward movement and disconnection from the anchor head by one or more stop lugs (not shown) or similar extending outward from the exterior surface of the anchor head.

Figure 21:
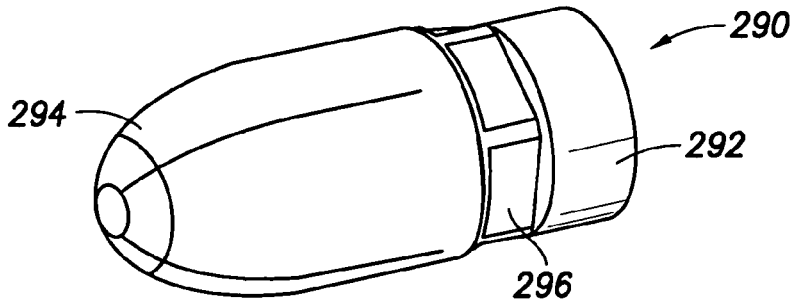
FIG. 21 is an alternate embodiment of a cover assembly for protecting the free end of a connector and communication line or other Point of Interest according to an aspect of the invention.

FIG. 21 is an alternate embodiment of a cover assembly for protecting the free end of a connector and communication line or other Point of Interest according to an aspect of the invention. The exemplary debris exclusion cover assembly 290 includes a base 292, a debris exclusion cover 294, and biasing elements (hidden, see FIG. 18). The base 292 allows attachment to a reciprocating block. In this embodiment the base is a metallic tubular having a threaded connection for insertion into a mating threaded end of a reciprocating block, such as block 144 or 154. A hex head 296 is provided to aid in connection. The cover 294 is preferably a rubber, plastic or composite material that can withstand downhole environments. The cover can be made of multiple pieces shaped to abut one another when in a closed position. The cover is biased closed by biasing elements.

Figure 22:
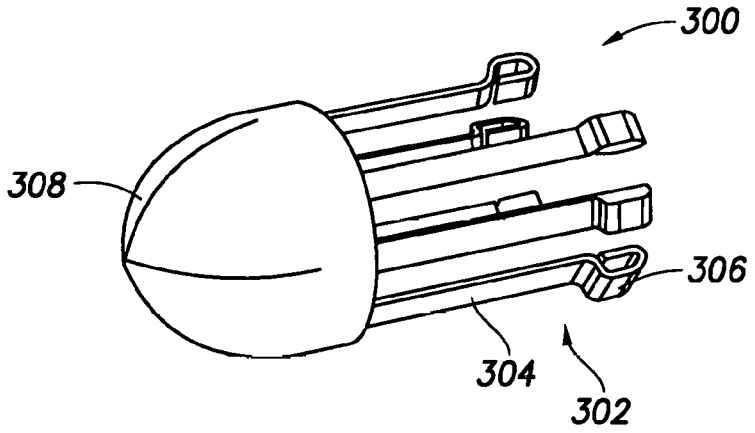
FIG. 22 is an alternate embodiment of a cover assembly according to an aspect of the invention.

FIG. 22 is an alternate embodiment of a cover assembly according to an aspect of the invention. Cover assembly 300 includes a collet assembly 302 with flexible collet arms 304 and dogs 306. The dogs cooperate with a corresponding lip or profiles on a bore of the reciprocating block. The cover 308 is supported at the end of the assembly and is biased closed.

Figure 23:
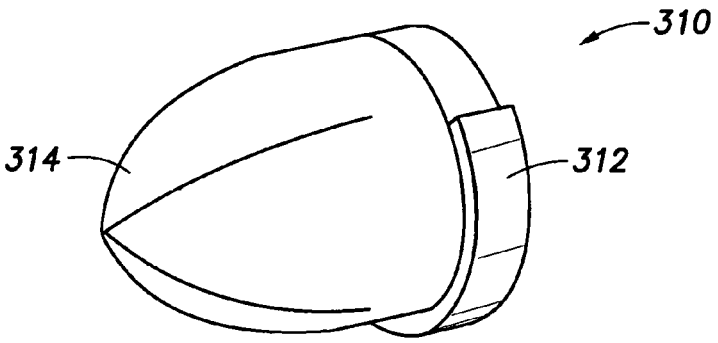
FIG. 23 is an alternate embodiment of a cover assembly according to an aspect of the invention.

FIG. 23 is an alternate embodiment of a cover assembly according to an aspect of the invention. A cover assembly 310 has a snap ring 312 or similar at its base which cooperates with a corresponding shoulder or lip in the reciprocating block. The cover 314 is similar to those previously discussed and is biased closed.

Figure 24:
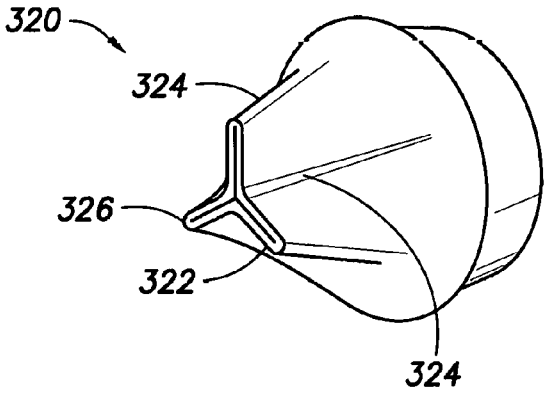
FIG. 24 is an alternate embodiment of a cover assembly according to an aspect of the invention.
Figure 25:
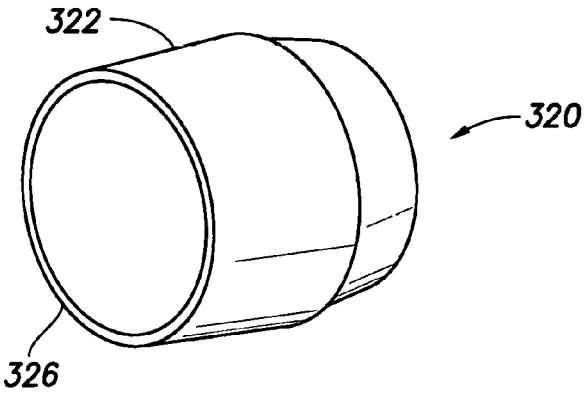
FIG. 25 is the alternate embodiment of a cover assembly seen in FIG. 24 according to an aspect of the invention.

FIG. 24 is an alternate embodiment of a cover assembly according to an aspect of the invention. FIG. 25 is the alternate embodiment of a cover assembly seen in FIG. 24 according to an aspect of the invention. The cover assembly 320 uses a cover 322 with axial folds 324 and is biased to a closed position, as shown, with a radially extending mouth 326 closed. In FIG. 25, the cover is in an open position with mouth 326 open and axial folds 324 in an unfolded position.

Figure 26:
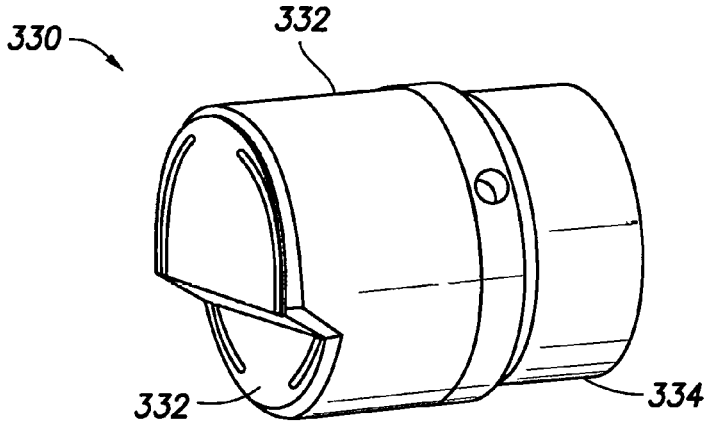
FIG. 26 is an alternate embodiment of a cover assembly according to an aspect of the invention.
Figure 27:
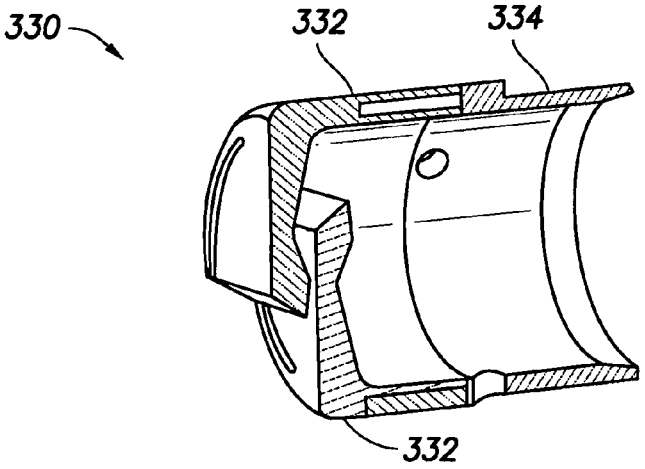
FIG. 27 is the alternate embodiment of a cover assembly as in FIG. 26 according to an aspect of the invention.

FIG. 26 is an alternate embodiment of a cover assembly according to an aspect of the invention. FIG. 27 is the alternate embodiment of a cover assembly as in FIG. 26 according to an aspect of the invention. FIG. 26 presents a cover assembly 330 with overlapping flaps 332 mounted on a base 334. FIG. 27 is a cross-sectional view showing the overlapping feature of the flaps. The cover is biased closed.

It is anticipated that it will be desirable to remove the upper tool assembly at some point during the life of the well, to repair or replace parts, to run different tools or strings, etc. In such a case, it is desirable to protect the Points of Interest from environmental fluids, debris, and contaminants. Consequently, after or during disconnection of the connectors, the connector blocks, both upper and lower, are forced back to their initial positions such the covers are moved toward the connector free ends. In the preferred embodiment, the lower connector block 154 is moved to its initial or closed position by a biasing element such as springs 156. The upper reciprocating block 144 is returned to its initial or closed position mechanically by a lug 143 for that purpose extending radially outward from the exterior surface of the mandrel 126. The covers, also biased to a closed position, close over the free ends of the fiber optic lines, thus protecting them during pull out of hole. The reciprocating debris exclusion assembly can be used repeatedly in well operations.

The methods and steps for removal of the upper tool assembly are briefly described and will be understood by those of skill in the art. The work string is pulled towards the surface (upwards in a vertical well) from the surface rig with enough force to pull the collet dogs 202 out of profile 200 in the scoop head. The resetting spring 206 is then free to expand as the work string is pulled further upwards. The metering assembly operates similarly to that described above but with the metering fluid and piston moving in the opposite direction. The metering fluid travels from chamber 218 to chamber 214. Keys 240 move radially outward to allow the mandrel 244 to move upward with the work string. Spring 234 expands. Sub 238 contacts mandrel 122. Anchor head 128 is then pulled away from the top sub 124. This releases lower block 154 and allows springs 156 to extend and move block 154 to cover the lower connector ends. The lower protective covers 162, due to the biasing elements therein, are moved to a closed position over the free ends of the lower connectors. As anchor head is moved upward relative to the mandrel 126, lug 143 extending radially outward from the exterior surface of the mandrel 126 contacts and pulls the reciprocating block 144 downward, back to its initial or closed position. The upper connector covers 152 return to a closed position over the free ends of the connector lines due to the biasing force of the biasing elements acting thereon. As anchor head 128 moves upward relative to mandrel 126, prop 130 is pulled from under keys 132, leaving the keys unsupported. The unsupported keys move radially inward, releasing the upper tool assembly and work string from the top sub of the lower tool assembly.

The reciprocating debris exclusion device disclosed herein can be used in combination with other tool assemblies; that is, with work strings made up for a different purpose, on coiled tubing or wireline, and to perform other functions which require the protection from debris of Points of Interest. The invention is limited only by the claims.

Figure 28:
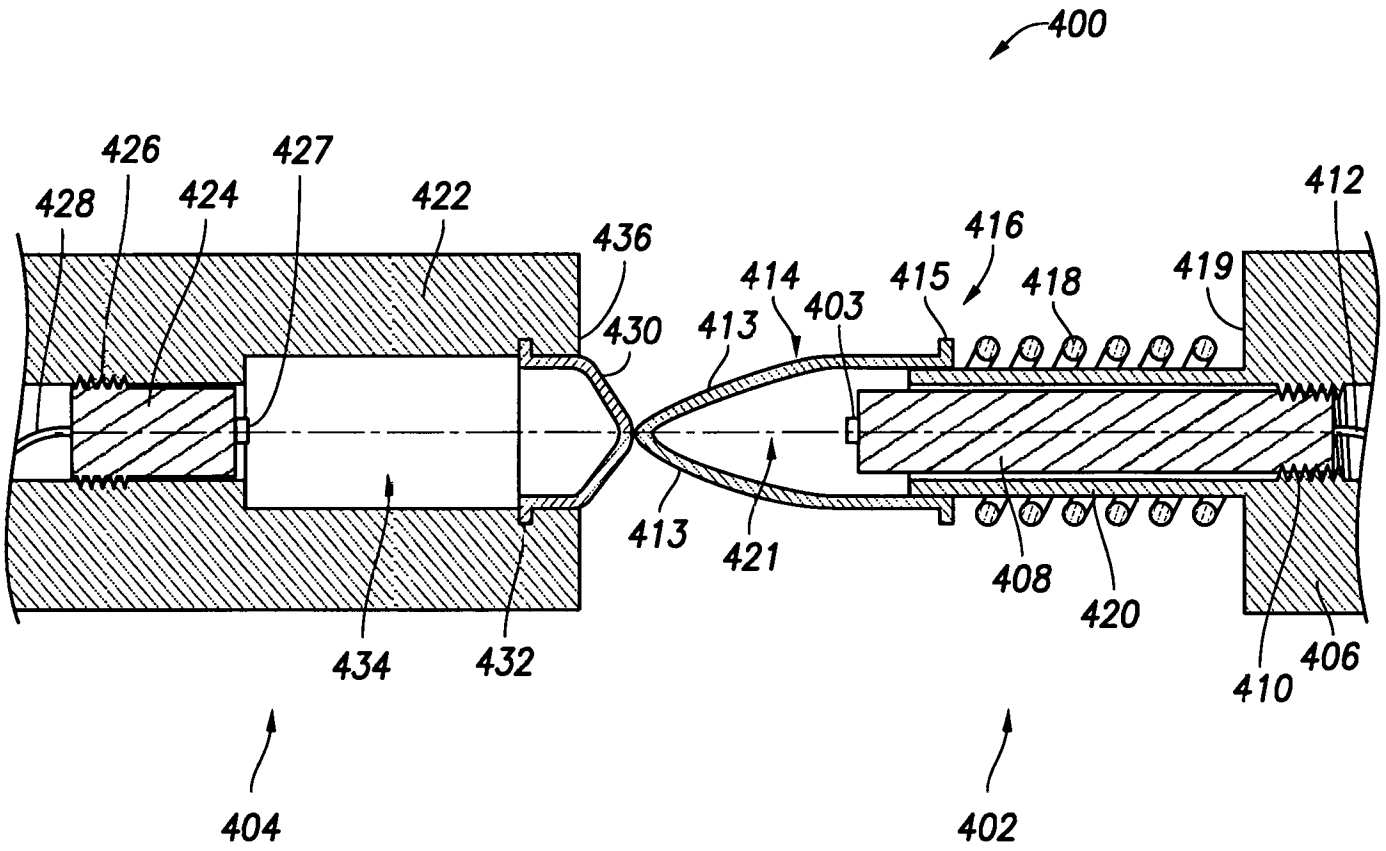
FIG. 28 is a side view in cross-section showing a reciprocating debris exclusion device according to an aspect of an invention disclosed herein.
Figure 29:
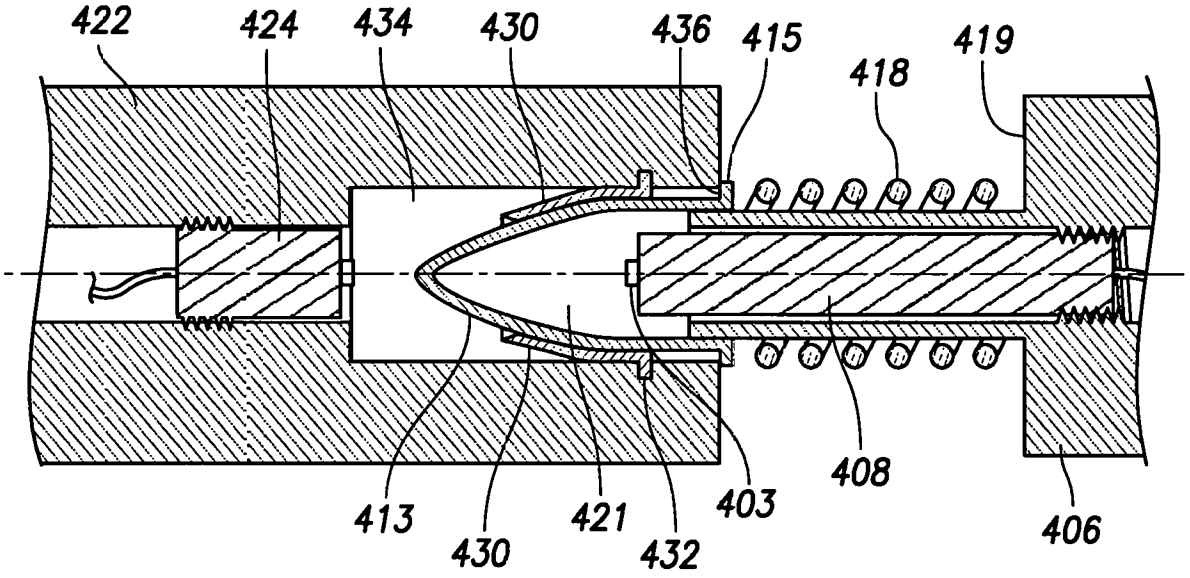
FIG. 29 is a side view in cross-section of the reciprocating debris exclusion device of FIG. 28 in a contact position according to an aspect of an invention disclosed herein.
Figure 30:
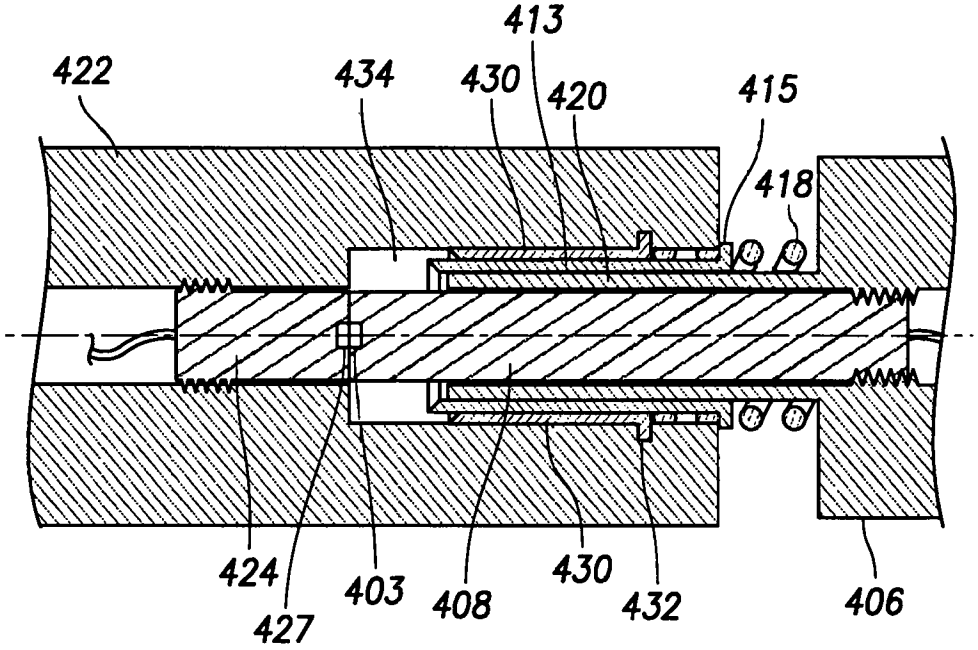
FIG. 30 is a side view in cross-section of the reciprocating debris exclusion device of FIG. 29 in a connected position according to an aspect of an invention disclosed herein.

FIGS. 28-30 are drawn to another embodiment of an exemplary debris exclusion device for protecting the free ends of connectors, communications lines, and other Points of Interest.

FIG. 28 is a side view in cross-section showing a reciprocating debris exclusion device 400 according to an aspect of an invention disclosed herein. FIG. 28 is a schematic and does not attempt to show various details of construction and operation. An upper connector assembly 402 and lower connector assembly 404 are seen in a disconnected position, just at contact as the assemblies are moved together.

The upper connector assembly 402 has a housing 406 with an upper connector 408 attached thereto and extending longitudinally therefrom. The connector is seen connected to the housing, such as at threads 410, and holds the free end 403 of a communication line 412 which runs to the surface, other downhole tools or sensors, etc. In the embodiment shown, the connector 408 remains stationary with respect to the housing, however, alternative arrangements can be used wherein the connector also moves relative to the housing, such as on a sliding block, biased element, etc. An upper connector cover 414 is initially in a closed position and protects the free end of the connector and communication line from debris and damage. The cover 414 has a flange 415 at its base 416 and is supported by a biasing element such as spring 418. The cover base 416 is preferably cylindrical and positioned exterior to a support cylinder 420 extending from the housing. The biasing spring 418 abuts a shoulder 419 defined on the housing at one end and a surface of the flange of the cover at the other end. As the cover reciprocates between a closed and open position, the cover slides with respect to and is supported by the support cylinder 420. In one embodiment, the interior chamber 421 defined by the upper cover is filled with a clean fluid, such as a heavy dielectric fluid.

The lower connector assembly 404 has a housing 422 with a lower connector 424 attached thereto. The connector is seen connected to the housing, such as at threads 426, and holds the free end 427 of a communication line 428 which runs other downhole tools or sensors, etc. In the embodiment shown, the connector 424 remains stationary with respect to the housing, however, alternative arrangements can be used wherein the connector moves relative to the housing. A lower connector cover 430 is initially in a closed position and protects the free end of the lower connector and lower communication line from debris and damage. The cover 430 has a flange 432 at its base, where it is attached to the housing 422. The closed cover 430, housing 422, and connector 424 end define a chamber 434 into which the free end of the communication line 428 extends. The chamber is preferably filled with a heavy dielectric fluid or other clean fluid.

FIG. 29 is a side view in cross-section of the reciprocating debris exclusion device of FIG. 28 in a contact position according to an aspect of an invention disclosed herein. In FIG. 29, the upper and lower assemblies are in contact and the upper connector cover 414 has contacted and penetrated the lower cover 430. Preferably the lower cover 430 is made of an elastomeric or flexible material such as rubber or plastic. The lower cover 430 can be a bladder, having no pre-existing holes, slits, cuts, folds, etc., or can have one or more pre-existing cuts such as seen in the covers disclosed elsewhere herein. Where the lower cover has pre-existing cuts, preferably a biasing element, such as seen elsewhere herein, biases the cover towards a closed position. In the preferred embodiment, the upper cover 414, still in its closed or initial position, penetrates the lower cover 430. The upper cover 414 is preferably made of a harder material than the lower cover, such as a metal, relatively hard plastic, rubber, etc. The upper cover is preferably comprised of a plurality of flaps or "petals" 413 which mate together in the closed position to protect or isolate the communication line end. The upper cover penetrates the lower cover and extends into the lower chamber 434. The upper cover flange 415 is sized and positioned to contact an annular stop-surface 436 defined on the lower assembly housing 422.

During positioning, the lower cover 430 wipes any contaminates from the exterior of the upper cover 414. Additionally, as the upper cover enters the lower chamber 434, the clean fluid therein is flushed out of the chamber, washing the exterior surfaces of the upper cover.

FIG. 30 is a side view in cross-section of the reciprocating debris exclusion device of FIG. 29 in a connected position according to an aspect of an invention disclosed herein. In FIG. 30, the upper and lower assemblies have been moved together and the communication lines, or wet-mates, are connected, allowing communication between the lines. The upper cover 414, at flange 415, contacts the stop-surface 436 of the lower housing 422 and moves relative to the upper housing 406 and connector 408 as the assemblies are moved toward one another. The upper cover 414 is now forced to an open position by the support cylinder 420 of the upper assembly. The preferred upper cover 414 has its plurality of folds or petals 413 forced open by the support cylinder 420. As the upper cover and support cylinder move relative to one another, the biasing spring 418 is compressed between shoulder 419 and flange 415. The upper and lower covers are "wiped" or moved toward or against the lower chamber wall fully exposing the free end 403 of the upper line 412. The upper and lower connectors are brought together by relative movement of the assemblies and communication is established through the line. The connector ends remain surrounded by clean fluid.

During disconnection, the upper assembly is pulled away from the lower assembly, the upper and lower lines disconnect, and, as the support cylinder is withdrawn from the lower chamber, the upper cover is forced back to its initial position by spring 418. In an embodiment where the upper cover is biased to a closed position, the upper cover closes over the end of the connector 408. Where the lower cover is resilient or biased towards a closed position, the lower cover returns towards its initial or closed position thereby protecting the lower connector. The embodiment shown is exemplary in nature. In other embodiments, where multiple disconnects and re-connects are anticipated, clean fluid reservoirs (not shown) can supply additional fluid during disconnection. For example, fluid can be pulled from the reservoirs by the suction caused during separation of the assemblies, thereby refilling the fluid chambers. Other arrangements will be apparent to those of skill in the art.

In preferred embodiments, the following methods are disclosed; the steps are not exclusive and can be combined in various orders, with steps omitted, repeated and/or performed in different order. A first downhole assembly, having a first connector with a free end of a first communication line fixed thereto, is positioned at a downhole location in the wellbore. A second downhole assembly, having a second connector with a free end of a second communication line fixed thereto, is moved into the wellbore and relative to the first downhole assembly. A first reciprocating member, mounted for movement on the first downhole assembly, is moved from an initial position to an actuated position, the first reciprocating member moving relative to the first connector. A second reciprocating member, mounted for movement on the second downhole assembly, is moved from an initial position to an actuated position, the second reciprocating member moving relative to the second connector. A first protective cover, attached to the first reciprocating member, is moved from an initial position, wherein the free end of the first communication line is protected from debris, to an open position, wherein the free end of the first communication line exposed. A second protective cover, attached to the second reciprocating member, is moved from an initial position wherein the free end of the second communication line is protected from debris to an open position wherein the free end of the second communication line is exposed. The first and second connectors are connected, establishing communication across the free ends of the first and second communication lines. The preceding steps can be accomplished in various orders, as will be clear upon review of the disclosure herein and as will be clear to persons of skill in the art. After use, the first and second connectors are disconnected. The first reciprocating member is returned to its initial position and the first cover is returned to its initial position wherein the free end of the first connector is protected from debris. Similarly, the second reciprocating member is returned to its initial position and the second cover is returned to its initial position wherein the free end of the second connector is protected from debris.

The steps during connection are in response to moving the second downhole assembly toward the first downhole assembly. The communication lines can be fiber optic, copper, or hydraulic lines. The second downhole assembly can be lowered on a work string, coiled tubing or wireline, for example. The method described, further comprising the step of positioning, in an interior space defined by a first mandrel of the first downhole assembly, a second mandrel of the second downhole assembly. The method described, further comprising the step of rotationally aligning the first and second downhole assemblies relative to one another. The method described, further comprising the step of contacting the first reciprocating member with the second downhole assembly and moving the first reciprocating member relative to the first connector in response to movement of the first downhole assembly. The method described, further comprising the step of contacting and moving the first reciprocating member with a selectively sliding sleeve mounted for longitudinal movement with respect to the second mandrel. The method described, further comprising the step of energizing a biasing element operable to move the first reciprocating member towards its initial position. The method described, further comprising wherein the sliding sleeve is an anchor head mounted slidingly on the second mandrel. The method described, further comprising, wherein the first reciprocating member is mounted for sliding movement on the first mandrel. The method described, further comprising, wherein the first connector is positioned in holes extending through the first reciprocating member. The method described, further comprising the step of contacting the second reciprocating member with the first downhole assembly and moving the second reciprocating member relative to the second connector in response to movement of the first downhole assembly with respect to the first downhole assembly. The method described, further comprising the step of contacting and moving the second reciprocating member with an actuating surface of the first downhole assembly. The method described, further comprising, wherein the actuating surface is a top surface of a bottom sub of the first downhole assembly. The method described, further comprising, wherein the second reciprocating member is mounted for movement on a selectively sliding sleeve of the second downhole assembly, and wherein the selectively sliding sleeve is mounted for movement on the second mandrel. The method described, further comprising, wherein the selectively sliding sleeve is an anchor head and acts to anchor the first and second downhole assemblies to one another. The method described, further comprising, wherein the first and second covers comprise multiple radially movable sections, the sections abutting one another when in an initial position and movable to an open position for exposing the free end of a communication line. The method described, further comprising, wherein the first and second covers are biased towards an initial closed position. The method described, further comprising, wherein the covers are biased by metal beam members attached to a circumferential base. The method described, further comprising, wherein the first and second covers are attached to their respective reciprocating members by a flange, a collet assembly, or a snap ring. The method described, further comprising, wherein the first and second covers each have axial folds defining adjacent cover sections. The method described, further comprising, wherein the first and second covers each have overlapping adjacent cover sections. The method described, further comprising, wherein the first and second connectors are wet-mate connectors. The method described, further comprising, wherein the step of disconnecting further comprises the step of pulling the second downhole assembly uphole. The method described, further comprising the step of returning the first reciprocating member toward its initial position using a biasing element. The method described, further comprising the step of returning the second reciprocating member towards its initial position using a lug extending from the second mandrel. The method described, further comprising the step of pulling the second downhole assembly out of the wellbore.

In another embodiment, an apparatus for excluding debris during a downhole wet-mate connection is presented. The apparatus includes a first downhole assembly having a housing, a first connector attached to the housing, a first communication line attached to the first connector, and a reciprocating cover member mounted for sliding engagement with the first housing. A second downhole assembly is provided, having a housing, a connector attached to the housing, a communication line having a free end attached to the connector, and a bladder cover member attached to the housing. The reciprocating cover member is moveable between a closed position, wherein the free end of the communication line is substantially enclosed, and an open position in which the free end of the communication line is exposed. The reciprocating cover member is moved in response to contact with the second downhole assembly. The bladder cover member is movable between a closed position, in which the bladder cover member substantially closes an otherwise open end of a housing chamber defined in the second downhole assembly, and an open position, wherein the bladder cover member is moved to open the open end of the housing chamber. The bladder cover member is moved to the open position by contact with the reciprocating cover member of the first downhole assembly. The reciprocating cover member can be biased towards the closed position by a spring element. The reciprocating cover member is preferably slidably mounted on the housing, such as slidably mounted on a cylindrical extension of the housing. The reciprocating cover member is preferably operable to move the bladder cover member to the open position. The reciprocating cover member is preferably operable to, prior to moving to an open position, move into the housing chamber. The housing chamber and the reciprocating cover member are preferably filled with a clean fluid, such as a dielectric fluid. The reciprocating cover member is preferably operable to move in response to relative movement of the first and second downhole assemblies. The housing of the second downhole assembly can define a surface for contacting and moving the reciprocating cover member axially. In a preferred embodiment, the connector of the first assembly is operable, in response to movement of the reciprocating cover member, to force open the reciprocating cover member. The bladder cover member can have pre-formed cuts, be made of elastomeric material, be spring biased toward the closed position, etc. The reciprocating cover member is preferably made of metal or other material stronger than the bladder cover. The reciprocating cover member is preferably biased towards a closed position. Additionally, the apparatus can include clean fluid reservoirs for re-filling the housing chamber and/or reciprocating cover member upon disconnection of the communication lines. The apparatus can provide clean fluid to the housing chamber or reciprocating cover member in response, for example, to suction pressure created during disconnection of the assemblies.

Exemplary methods of use of the invention are described, with the understanding that the invention is determined and limited only by the claims. Those of skill in the art will recognize additional steps, different order of steps, and that not all steps need be performed to practice the inventive methods described.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. An apparatus for excluding debris during a downhole wet-mate connection, the apparatus comprising:

a) a first downhole assembly having a first housing, a first connector attached to the first housing, a first communication line having a free end attached to the first connector, and a reciprocating cover member mounted for sliding engagement with the first housing;

b) a second downhole assembly having a second housing, a second connector attached to the second housing, a second communication line having a free end attached to the second connector, and a bladder cover member attached to the second housing;

c) wherein the reciprocating cover member is moveable between a closed position in which the free end of the first communication line is substantially enclosed and an open position in which the free end of the first communication line is exposed;

d) wherein the reciprocating cover member is moved in response to contact with the second downhole assembly;

e) wherein the bladder cover member is movable between a closed position in which the bladder cover member substantially closes an otherwise open end of a housing chamber defined in the second downhole assembly and an open position in which the bladder cover member is moved to open the open end of the housing chamber;

f) wherein the bladder cover member is moved to the open position by contact with the reciprocating cover member of the first downhole assembly;

g) wherein the reciprocating cover member is operable to move the bladder cover member to the open position; and h) wherein the reciprocating cover member is operable to, prior to moving to an open position, move into the housing chamber.

2. The apparatus of claim 1, wherein the reciprocating cover member is biased towards the closed position by a spring element.

3. The apparatus of claim 2, wherein the spring element abuts a flange of the reciprocating cover member at one end and a shoulder of the first housing at the other end.

4. The apparatus of claim 2, wherein the reciprocating cover member is slidably mounted on the first housing.

5. The apparatus of claim 4, wherein the reciprocating cover member is slidably mounted on a cylindrical extension of the first housing.

6. The apparatus of claim 1, wherein the reciprocating cover member is operable to move in response to relative movement of the first and second downhole assemblies.

7. The apparatus of claim 6, wherein the housing of the second downhole assembly defines a surface for contacting and moving the reciprocating cover member axially.

8. The apparatus of claim 1, wherein the first connector is operable, in response to movement of the reciprocating cover member, to force open the reciprocating cover member.

9. The apparatus of claim 1, wherein the free end of the second communication line is positioned within the housing chamber of the second downhole assembly prior to movement of the reciprocating cover member to the open position.

10. An apparatus for excluding debris during a downhole wet-mate connection, the apparatus comprising:

a) a first downhole assembly having a first housing, a first connector attached to the first housing, a first communication line having a free end attached to the first connector, and a reciprocating cover member mounted for sliding engagement with the first housing;

b) a second downhole assembly having a second housing, a second connector attached to the second housing, a second communication line having a free end attached to the second connector, and a bladder cover member attached to the second housing;

c) wherein the reciprocating cover member is moveable between a closed position in which the free end of the first communication line is substantially enclosed and an open position in which the free end of the first communication line is exposed;

d) wherein the reciprocating cover member is moved in response to contact with the second downhole assembly;

e) wherein the bladder cover member is movable between a closed position in which the bladder cover member substantially closes an otherwise open end of a housing chamber defined in the second downhole assembly and an open position in which the bladder cover member is moved to open the open end of the housing chamber;

f) wherein the bladder cover member is moved to the open position by contact with the reciprocating cover member of the first downhole assembly; and g) wherein the housing chamber and the reciprocating cover member are filled with a clean fluid.

11. The apparatus of claim 10, wherein at least one of the first and second downhole assemblies includes a clean fluid reservoir for re-filling the housing chamber or reciprocating cover member upon disconnection of the communication lines.

12. The apparatus of claim 11, wherein the first or second assembly is operable to provide clean fluid to the housing chamber or reciprocating cover member in response to suction pressure created during disconnection of the assemblies.

13. An apparatus for excluding debris during a downhole wet-mate connection, the apparatus comprising:

a) a first downhole assembly having a first housing, a first connector attached to the first housing, a first communication line having a free end attached to the first connector, and a reciprocating cover member mounted for sliding engagement with the first housing;

b) a second downhole assembly having a second housing, a second connector attached to the second housing, a second communication line having a free end attached to the second connector, and a bladder cover member attached to the second housing;

c) wherein the reciprocating cover member is moveable between a closed position in which the free end of the first communication line is substantially enclosed and an open position in which the free end of the first communication line is exposed;

d) wherein the reciprocating cover member is moved in response to contact with the second downhole assembly;

e) wherein the bladder cover member is movable between a closed position in which the bladder cover member substantially closes an otherwise open end of a housing chamber defined in the second downhole assembly and an open position in which the bladder cover member is moved to open the open end of the housing chamber;

f) wherein the bladder cover member is moved to the open position by contact with the reciprocating cover member of the first downhole assembly; and g) wherein the reciprocating cover member is operable to penetrate the bladder cover member.

14. The apparatus of claim 13, wherein the bladder cover member has pre-formed cuts therein.

15. The apparatus of claim 13, wherein the bladder cover member is made of an elastomeric material and returns towards its closed position upon removal of the reciprocating cover member from the housing chamber.

16. The apparatus of claim 13, wherein the reciprocating cover member is made of metal.

17. The apparatus of claim 13, wherein the reciprocating cover member is biased towards the closed position.

18. The apparatus of claim 13, wherein the reciprocating cover member is actuatable after the reciprocating cover member has penetrated the bladder cover member.

19. The apparatus of claim 18, wherein the reciprocating cover member is operable to return to a closed position prior to complete removal from the housing chamber of the first downhole assembly.

20. The apparatus of claim 18, wherein the free end of the second communication line is positioned within the housing chamber of the first second downhole assembly prior to movement of the reciprocating cover member to the open position.

* * * * *